US011346082B2

(12) United States Patent
Akami

(10) Patent No.: US 11,346,082 B2
(45) Date of Patent: May 31, 2022

(54) FLUID PRESSURE DRIVE DEVICE

(71) Applicant: NABTESCO CORPORATION, Tokyo (JP)

(72) Inventor: Toshiya Akami, Tokyo (JP)

(73) Assignee: NABTESCO CORPORATION, Tokyo (JP)

( * ) Notice: Subject to any disclaimer, the term of this patent is extended or adjusted under 35 U.S.C. 154(b) by 0 days.

(21) Appl. No.: 17/211,201

(22) Filed: Mar. 24, 2021

(65) Prior Publication Data

US 2021/0332565 A1 Oct. 28, 2021

(30) Foreign Application Priority Data

Apr. 28, 2020 (JP) ..... JP2020-079149

(51) Int. Cl.
*F04B 39/10* (2006.01)
*E02F 9/22* (2006.01)
(Continued)

(52) U.S. Cl.
CPC ..... *E02F 9/2235* (2013.01); *E02F 9/2228* (2013.01); *E02F 9/2296* (2013.01); *F04B 49/08* (2013.01); *F15B 11/161* (2013.01); *F15B 11/17* (2013.01); *F04B 39/1066* (2013.01); *F15B 2211/20576* (2013.01)

(58) Field of Classification Search
CPC ..... F01B 3/0055; F01B 3/0058; F01B 3/106; F04B 1/0465; F04B 39/1066; F04B 49/08; F15B 11/161; F15B 11/17; F15B 2211/20576
See application file for complete search history.

(56) References Cited

U.S. PATENT DOCUMENTS 3,587,404 A * 6/1971 Kratzenberg ..... F01B 3/109 91/505
6,055,809 A * 5/2000 Kishi ..... B63H 25/12 417/270

(Continued)

FOREIGN PATENT DOCUMENTS

GB 2448652 A 10/2008
JP 2017-061795 A 3/2017
JP 2017061795 A * 3/2017

OTHER PUBLICATIONS

European Search Repod dated Jul. 15, 2021, issued in corresponding European Patent Application No. 21164872.0 (9 pgs.).

*Primary Examiner* — Michael Leslie
(74) *Attorney, Agent, or Firm* — Pillsbury Winthrop Shaw Pittman, LLP

(57) ABSTRACT

A hydraulic drive device according to an embodiment includes a main pump and a single pressure gauge. The main pump controls discharge flow rates of a first hydraulic oil and a second hydraulic oil discharged into two or more first pressure oil supply passage and second pressure oil supply passage with a single swash plate. The main pump is a swash plate variable displacement type split flow hydraulic pump. The pressure gauge measures an intermediate pressure of the discharged fluid at a merging point between the first pressure oil supply passage and the second pressure oil supply passage. The discharge flow passage is controlled based on a pressure value obtained by the pressure gauge.

11 Claims, 13 Drawing Sheets

(51) Int. Cl.

| | |
|---|---|
| ***F04B 49/08*** | (2006.01) |
| ***F15B 11/16*** | (2006.01) |
| ***F15B 11/17*** | (2006.01) |

(56) References Cited

U.S. PATENT DOCUMENTS

| | | | | |
|---|---|---|---|---|
| 6,912,849 | B2 * | 7/2005 | Inoue | E02F 9/2228 60/475 |
| 7,905,711 | B2 * | 3/2011 | Mochizuki | F04B 23/12 417/269 |
| 8,948,983 | B2 * | 2/2015 | Horii | E02F 9/22 701/50 |
| 9,845,589 | B2 * | 12/2017 | Tsuruga | F15B 11/17 |
| 9,976,283 | B2 * | 5/2018 | Tsuruga | F15B 13/025 |
| 10,107,311 | B2 * | 10/2018 | Takahashi | F15B 11/17 |
| 2013/0251490 | A1 | 9/2013 | Horii et al. | |
| 2016/0265560 | A1 | 9/2016 | Yoshida et al. | |

* cited by examiner

FLUID PRESSURE DRIVE DEVICE

CROSS-REFERENCE TO RELATED APPLICATIONS

This application is based on and claims the benefit of priority from Japanese Patent Application Serial No. 2020-079149 (filed on Apr. 28, 2020), the contents of which are hereby incorporated by reference in their entirety.

TECHNICAL FIELD

The present invention relates to a fluid pressure drive device.

BACKGROUND

As one type of pump used in a hydraulic drive device for a construction machine, there is a so-called split flow pump having a plurality of (for example, two) discharge ports (see, for example, Japanese Patent Application Publication No. 2017-061795 ("the '795 Publication")).

Construction equipment (particularly, mini excavators) is required to accurately control a pump absorption horsepower of a split flow pump for fuel saving. To address this, for example, computerization of the hydraulic drive device of the '795 Publication may be considered to accurately control the pump absorption horsepower of the split flow pump.

However, computerization of the above-described conventional hydraulic drive device requires a plurality of pressure gauges each of which is provided at each discharge port for hydraulic fluid, which increases the cost of the hydraulic drive device. Therefore, it is not preferable to adopt this type of hydraulic drive device for mini excavators as an inexpensive device is desirable for them.

SUMMARY

The present invention provides a fluid pressure drive device capable of accurately controlling the pump absorption horsepower of, for example, a split flow pump and reducing costs.

A fluid pressure drive device according to one aspect of the invention includes: a fluid pressure pump controlling discharge flow rates of fluid flows discharged into two or more discharge flow passages with a single swash plate; a single pressure detection unit detecting an intermediate pressure of the discharged fluid flows at a merging point of the two or more discharge flow passages; a control unit controlling the discharge flow rates based on a pressure value detected by the pressure detection unit.

According to the aspect, it is possible to control the discharge flow rates of the fluid flows discharged into the two or more discharge flow passages with the single swash plate of, for example, a split flow type pump and to detect the pressures of the discharged fluid flows at the merging point of the two or more discharge flow passages with the single pressure detection unit. Thus, it is not necessary to provide two or more pressure gauges, and increase of the cost of the fluid pressure drive device is prevented.

In addition, pressures of the discharged fluid flows at the merging point of the two or more discharge flow passages are detected, an average pressure is calculated based on the detected pressure values, and the pump absorption torque can be calculated such that the swash plate angle corresponds to a stroke volume appropriate for the average pressure. Therefore, it is possible to determine the maximum pump absorption horsepower based on the calculated pump absorption torque, for example, from the external environment or the revolution speed of the engine. Thereby, based on the determined pump maximum absorption horsepower, for example, the discharge flow rate can be controlled to the pump maximum absorption horsepower determined by the control unit based on the swash plate angle calculated from the average pressure. By computerization of the hydraulic drive device in this way, it is possible to accurately control the pump absorption horsepower of the split flow pump.

In the above fluid pressure drive device, the fluid pressure pump may include: a cylinder which the fluid is suctioned to and discharged from; and a valve plate dividing the fluid and guiding the fluid flows discharged from the cylinder to the two or more discharge flow passages.

In the above fluid pressure drive device, the valve plate may have two or more outlet ports communicated with the two or more discharge flow passages respectively, and the intermediate pressure may be picked up from a passage that communicates with the two or more outlet ports.

In the above fluid pressure drive device, the fluid pressure pump may have a casing that houses the cylinder and the valve plate, and the intermediate pressure may be picked up from a passage that communicates with each outlet passage of the casing.

A fluid pressure drive device according to another aspect of the invention includes: a fluid pressure pump controlling discharge flow rates of fluid flows discharged into two or more discharge flow passages with a single swash plate; a single pressure detection unit alternately detecting each one of pressures of the discharged fluid flows discharged into the two or more discharge flow passages; and a control unit controlling the discharge flow rates based on a pressure value detected by the pressure detection unit.

According to the aspect, it is possible to control the discharge flow rates of the fluid flows discharged into the two or more discharge flow passages with the single swash plate of, for example, a split flow type pump and to alternately detect one of the pressures of the discharged fluid flows discharged into the two or more discharge flow passages. Thus, it is not necessary to provide two or more pressure gauges, and increase of the cost of the fluid pressure drive device is prevented.

One of the pressures of the fluid flows discharged into the two or more discharge flow passages is alternately detected, an average pressure is calculated based on the detected pressure values, and the pump absorption torque can be calculated such that the swash plate angle corresponds to a stroke volume appropriate for the average pressure. Therefore, it is possible to determine the maximum pump absorption horsepower based on the calculated pump absorption torque, for example, from the external environment or the revolution speed of the engine. Thereby, based on the determined pump maximum absorption horsepower, for example, the discharge flow rate can be controlled to the pump maximum absorption horsepower determined by the control unit based on the swash plate angle calculated from the average pressure. By computerization of the hydraulic drive device in this way, it is possible to accurately control the pump absorption horsepower of the split flow pump.

In the above fluid pressure drive device, the control unit may control the swash plate based on an average pressure obtained from pressures alternately detected by the pressure detection unit.

In the above fluid pressure drive device, each of the pressures of the discharged fluid flows discharged into the two or more discharge flow passages may be a high-pressure side piston pressure picked up on the swash plate side.

In the above fluid pressure drive device, the fluid pressure pump includes: a cylinder having a cylinder chamber; and a piston movable in the cylinder chamber, the piston suctioning fluid into the cylinder chamber and discharging fluid from the cylinder chamber. The high-pressure side piston pressure may be picked up from the swash plate after the piston.

In the above fluid pressure drive device, the control unit determines a maximum absorption horsepower of the pump based on the pressure value detected by the pressure detection unit, and the fluid pressure drive device may further include a solenoid valve controlled based on the maximum absorption horsepower of the pump.

In the above fluid pressure drive device, the control unit may determine a swash plate angle of the swash plate based on the maximum absorption horsepower of the pump, and the solenoid valve may control the swash plate based on the swash plate angle of the swash plate.

A fluid pressure drive device according to yet another aspect of the invention includes: a fluid pressure pump controlling discharge flow rates of fluid flows discharged into two or more discharge flow passages with a single swash plate; a single pressure detection unit detecting an intermediate pressure of the discharged fluid flows at a merging point of the two or more discharge flow passages; a control unit determining a swash plate angle of the swash plate based on a pressure value detected by the pressure detection unit; and a solenoid valve controlling the swash plate based on the swash plate angle.

According to the aspect, it is possible to control the discharge flow rates of the fluid flows discharged into the two or more discharge flow passages with the single swash plate of, for example, a split flow type pump and to detect the pressures of the discharged fluid flows at the merging point of the two or more discharge flow passages with the single pressure detection unit. Thus, it is not necessary to provide two or more pressure gauges, and increase of the cost of the fluid pressure drive device is prevented.

In addition, pressures of the discharged fluid flows at the merging point of the two or more discharge flow passages are detected, an average pressure is calculated based on the detected pressure values, and the pump absorption torque can be calculated such that the swash plate angle corresponds to a stroke volume appropriate for the average pressure. Therefore, it is possible to determine the maximum pump absorption horsepower based on the calculated pump absorption torque, for example, from the external environment or the revolution speed of the engine. Thereby, based on the determined pump maximum absorption horsepower, for example, the discharge flow rate can be controlled to the pump maximum absorption horsepower determined by the control unit based on the swash plate angle calculated from the average pressure. By computerization of the hydraulic drive device in this way, it is possible to accurately control the pump absorption horsepower of the split flow pump.

A fluid pressure drive device according to still yet another aspect of the invention includes: a fluid pressure pump controlling discharge flow rates of fluid flows discharged into two or more discharge flow passages with a single swash plate; a single pressure detection unit alternately detecting any one of pressures of the discharged fluid flows discharged into the two or more discharge flow passages; a control unit determining a swash plate angle of the swash plate based on a pressure value detected by the pressure detection unit; and a solenoid valve controlling the swash plate based on the swash plate angle.

According to the aspect, it is possible to control the discharge flow rates of the fluid flows discharged into the two or more discharge flow passages with the single swash plate of, for example, a split flow type pump and to alternately detect one of the pressures of the discharged fluid flows discharged into the two or more discharge flow passages. Thus, it is not necessary to provide two or more pressure gauges, and increase of the cost of the fluid pressure drive device is prevented.

One of the pressures of the fluid flows discharged into the two or more discharge flow passages is alternately detected, an average pressure is calculated based on the detected pressure values, and the pump absorption torque can be calculated such that the swash plate angle corresponds to a stroke volume appropriate for the average pressure. Therefore, it is possible to determine the maximum pump absorption horsepower based on the calculated pump absorption torque, for example, from the external environment or the revolution speed of the engine. Thereby, based on the determined pump maximum absorption horsepower, for example, the discharge flow rate can be controlled to the pump maximum absorption horsepower determined by the control unit based on the swash plate angle calculated from the average pressure. By computerization of the hydraulic drive device in this way, it is possible to accurately control the pump absorption horsepower of the split flow pump.

ADVANTAGEOUS EFFECTS

According to the fluid pressure drive device described above, it is possible to accurately control, for example, the pump absorption horsepower of a split flow pump and reduce costs.

DESCRIPTION OF THE EMBODIMENTS

Embodiments of the present invention will be hereinafter described with reference to the drawings.

First Embodiment

Construction Equipment

Figure 1:
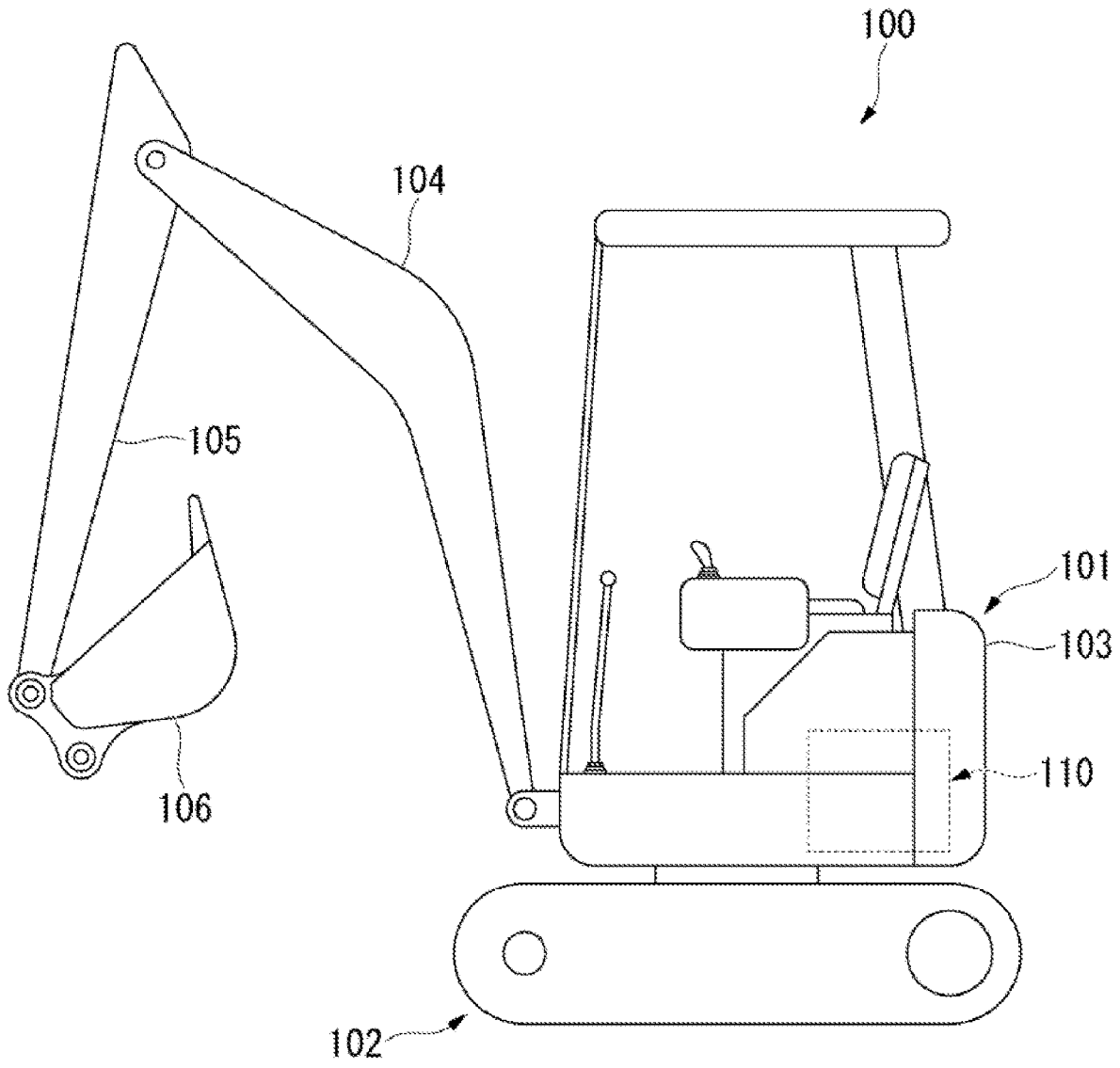
FIG. 1 schematically illustrates configuration of a construction machine according to a first embodiment of the invention.

FIG. 1 schematically illustrates the configuration of a construction machine 100 according to the first embodiment of the invention. As shown in FIG. 1, the construction machine 100 is, for example, a hydraulic excavator. The construction machine 100 includes a slewable upper structure 101 and an undercarriage 102. The upper structure 101 slews or rotates upon the undercarriage 102. The slewable upper structure 101 includes a hydraulic drive device (an example of a fluid pressure drive device in claims) 110.

The slewable upper structure 101 includes a cab 103, a boom 104, an arm 105, and a bucket 106. The cab 103 supports an operator boarding the slewable upper structure 101. One end of the boom 104 is connected to a main body of the slewable upper structure 101. The boom 104 is configured to swing relative to the main body of the slewable upper structure 101. One end of the arm 105 is connected to an end (tip) of the boom 104 opposite to the main body of the slewable upper structure 101. The arm 105 is swingable relative to the boom 104. The bucket 106 is connected to an end (tip) of the arm 105 opposite to the boom 104. The bucket 106 is swingable relative to the arm 105. A main part of the hydraulic drive device 110 is disposed in the cab 103, for example. The hydraulic oil (hydraulic fluid) supplied from the hydraulic drive device 110 drives the cab 103, the boom 104, the arm 105, and the bucket 106.

Hydraulic Drive Device

Figure 2:
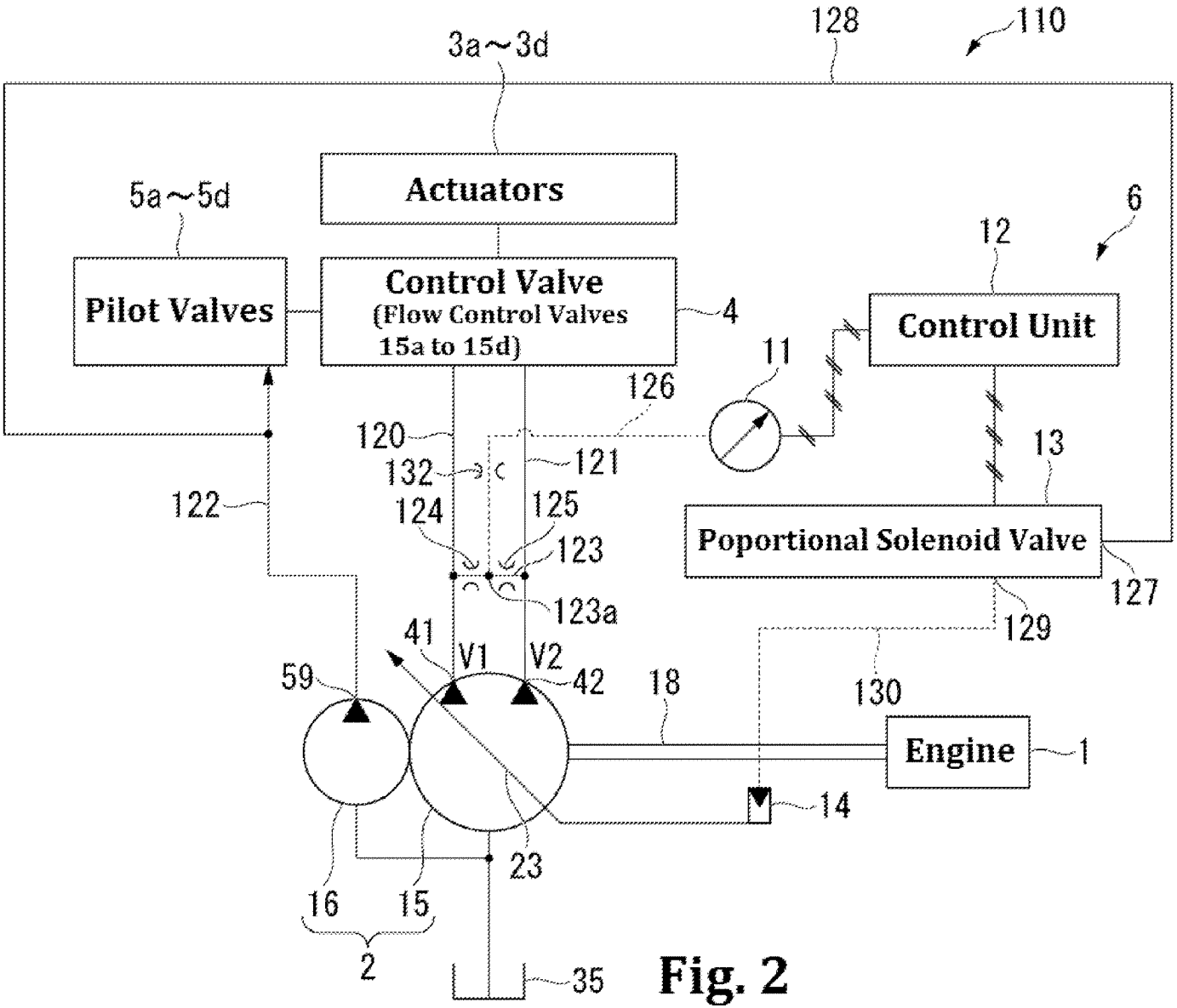
FIG. 2 schematically illustrates a hydraulic drive device of the construction machine according to the first embodiment of the invention.

FIG. 2 schematically illustrates the hydraulic drive device 110 of the construction machine 100. As shown in FIG. 2, the hydraulic drive device 110 includes a power source 1, a pump unit 2, a plurality of actuators 3*a* to 3*d*, a control valve 4, a plurality of pilot valves 5*a* to 5*d*, and a torque control unit 6. The torque control unit 6 includes a pressure gauge (an example of a pressure detection unit in claims) 11, a control unit 12, a proportional solenoid valve (an example of a solenoid valve in claims) 13, and a swash plate control actuator 14. The power source 1 is, for example, a diesel engine (hereinafter referred to as an engine 1).

Pump Unit

Figure 3:
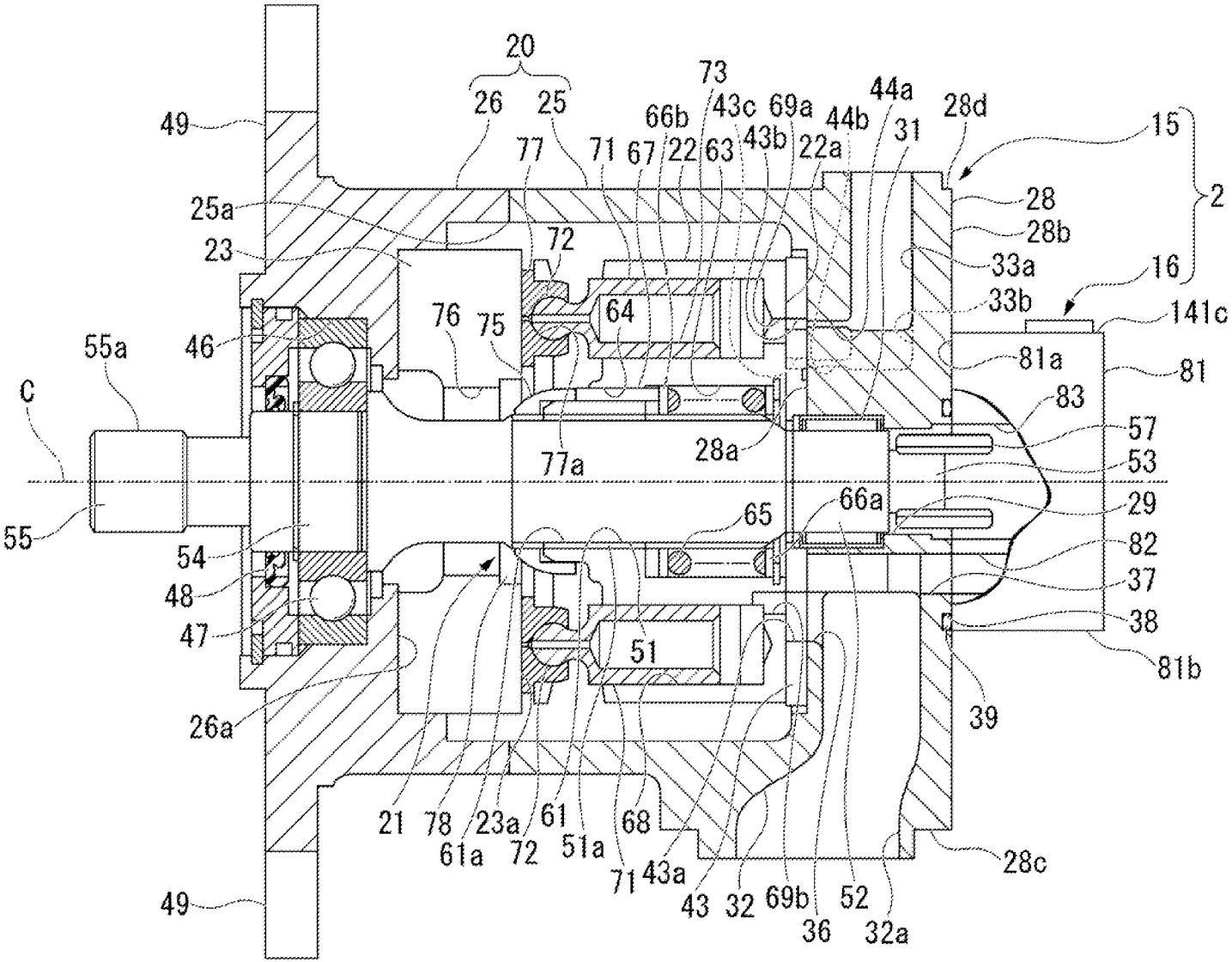
FIG. 3 illustrates configuration of a pump unit according to the first embodiment of the invention, a part of which is partially removed to show the inside.

FIG. 3 illustrates configuration of the pump unit, a part of which is partially removed to show the inside. FIG. 3 shows only the main pump 15 in a cross section along the axial direction. In FIG. 3, the scale of each member is appropriately changed for clarifying description. As shown in FIGS. 2 and 3, the pump unit 2 is a so-called hydraulic pump that suctions and discharges hydraulic oil. The pump unit 2 includes an integrated main pump (an example of a fluid pressure pump in claims) 15 and a pilot pump 16 as an additional pump. The main pump 15 and the pilot pump 16 are coupled in tandem to a drive shaft 18 of the engine 1 and are driven by the engine 1.

Main Pump

The main pump 15 is what we call a swash plate variable displacement type split flow hydraulic pump. The main pump 15 essentially includes a main casing 20, a shaft 21, a cylinder block (an example of a cylinder in claims) 22, and a swash plate 23. The shaft 21 rotates on a central axis C relative to the main casing 20. The cylinder block 22 is housed in the main casing 20 and fixed to the shaft 21. The swash plate 23 is housed in the main casing 20 and rotates relative to the main casing 20 to control the amount of hydraulic oil discharged from the main pump 15. In the following description, a direction parallel to the central axis C of the shaft 21 is referred to as an axial direction, a rotational direction of the shaft 21 is referred to as a circumferential direction, and a radial direction of the shaft 21 is simply referred to as a radial direction.

The main casing 20 includes a box-shaped casing main body 25 having an opening 25*a*, and a front flange 26 that closes the opening 25*a* of the casing main body 25. The casing body 25 has a bottom wall 28 on the side opposite to the opening 25*a*. The cylinder block 22 is disposed on the side closer to an inner surface 28*a* of the bottom wall 28. The pilot pump 16 is attached to an outer surface 28*b* of the bottom wall 28.

A rotational shaft insertion hole 29 through which the shaft 21 can be inserted is formed in the wall 28 such that it penetrates in a thickness direction of the bottom wall 28. A bearing 31 that rotatably supports one end of the shaft 21 is provided on the side closer to the inner surface 28*a* of the bottom wall 28 (on the side opposite to the opening 25*a*). The bottom wall 28 is a wall portion of the casing main body 25 situated on the central axis C of the shaft 21.

In the bottom wall 28, a first inlet passage 32, a first outlet passage 33*a* and a second outlet passage 33*b* are formed on each side of the shaft 21 in the radial direction. The first inlet passage 32 communicates with an inlet port 32*a* formed in a first side surface 28*c* of the bottom wall 28. The inlet port 32*a* leads to the tank 35. The first inlet passage 32 extends into the bottom wall 28 such that its opening area gradually decreases from the first side surface 28*c* toward the shaft 21.

An O-ring groove 38 is formed in the outer surface 28*b* of the bottom wall 28 such that it surrounds the rotational shaft insertion hole 29 and a second communication passage 37. The O-ring 39 is disposed in the O-ring groove 38. The O-ring 39 ensures sealing between the main casing 20 and a gear casing 81 of the pilot pump 16, which will be described later.

With the above described configuration, the hydraulic oil is suctioned from the tank 35 into the first inlet passage 32 through the inlet port 32*a*. The hydraulic oil suctioned into the first inlet passage 32 flows into a first communication passage 36 and a second communication passage 37.

At an outlet of the first outlet passage 33*a*, a first discharge port 41 is formed in a second side surface 28*d* situated on the opposite side of the shaft 21 from the first side surface 28*c* of the bottom wall 28. Further, at an outlet of the second outlet passage 33*b*, a second discharge port 42 is formed in the second side surface 28*d* situated on the opposite side of the shaft 21 from the first side surface 28*c* of the bottom wall 28. The first discharge port 41 and the second discharge port 42 are connected to the actuators 3*a* to 3*d* via a control valve 4 or the like.

The first outlet passage 33*a* and the second outlet passage 33*b* extend into the bottom wall 28 from the second side surface 28*d* toward the shaft 21. At the end of the first outlet passage 33*a* situated closer to the shaft 21, formed is a third communication passage 44*a* (an example of a discharge flow passage or outlet passage in claims) that communicatively connects the first outlet passage 33*a* with the inner surface 28*a* of the bottom wall 28. The third communication passage 44*a* communicatively connects the first outlet passage 33*a* and an outer peripheral outlet port 43*b* of a valve plate 43, which will be described later. At the end of the second outlet passage 33*b* situated closer to the shaft 21, formed is a fourth communication passage 44*b* (an example of a discharge flow passage or outlet passage in claims) that communicatively connects the second outlet passage 33*b* with the inner surface 28*a* of the bottom wall 28. The fourth communication passage 44*a* communicatively connects the second outlet passage 33*b* and an inner peripheral outlet port 43*c* of the valve plate 43, which will be described later.

In the front flange 26, formed is a through hole 46 through which the shaft 21 can be inserted. A bearing 47 that rotatably supports the other end side of the shaft 21 is disposed in the through hole 46. An oil seal 48 is provided in the through hole 46 on the side opposite to the casing main body 25 (outside the front flange 26) with respect to the bearing 47. Two attachment plates 49 for fixing the main pump 15 to the slewable upper structure 101 (see FIG. 1) and the like are integrally formed with the front flange 26. The two attachment plates 49 are arranged on each side of the shaft 21 in the radial direction. The attachment plates 49 extend radially toward the outside.

The shaft 21 has stepped portions. The shaft 21 includes a rotational shaft main body 51, a first bearing portion 52, a transmission shaft 53, a second bearing portion 54, and a connecting shaft 55 that are arranged coaxially. The rotational shaft main body 51 is disposed in the main casing 20. The first bearing portion 52 is integrally formed with an end portion of the rotational shaft main body 51 situated closer to the bottom wall 28 of the casing main body 25. The transmission shaft 53 is integrally formed with an end of the first bearing portion 52 on the side opposite to the rotating shaft main body 51. The second bearing portion 54 is integrally formed with an end portion of the rotational shaft main body 51 on the side closer to the front flange 26. The connecting shaft 55 is integrally formed with an end of the second bearing portion 54 opposite to the rotational shaft main body 51.

A second spline 51*a* is formed on the rotational shaft main body 51. The cylinder block 22 is fitted to the second spline 51*a* of the rotational shaft main body 51. The shaft diameter of the first bearing portion 52 is smaller than the shaft diameter of the rotational shaft main body 51. The first bearing portion 52 is rotatably supported by the bearing 31 in the bottom wall 28.

The transmission shaft 53 transmits rotational force of the shaft 21 to the pilot pump 16. The shaft diameter of the transmission shaft 53 is smaller than the shaft diameter of the first bearing portion 52. The transmission shaft 53 projects toward the pilot pump 16 through the bearing 31. The transmission shaft 53 is disposed in the rotational shaft insertion hole 29 of the bottom wall 28. A cylindrical coupling 57 is fitted on an outer peripheral surface of the transmission shaft 53. The coupling 57 rotates together with the transmission shaft 53. A side of the coupling 57 closer to the pilot pump 16 projects from the bottom wall 28 toward the pilot pump 16. The protruding portion of the coupling 57 on the pilot pump 16 side is coupled to the pilot pump 16.

The shaft diameter of the second bearing portion 54 is larger than the shaft diameter of the first bearing portion 52. The second bearing portion 54 is rotatably supported by the bearing 47 in the front flange 26. The connecting shaft 55 is connected to the drive shaft 18 of the engine 1. The shaft diameter of the connecting shaft 55 is smaller than the shaft diameter of the second bearing portion 54. A tip of the connecting shaft 55 projects to the outside of the front flange 26 through the bearing 47. The oil seal 48 prevents leak of hydraulic oil from the inside and prevents foreign matter and the like from entering between the tip of the connecting shaft 55 and the front flange 26. A first spline 55*a* is formed at the tip of the connecting shaft 55. The drive shaft 18 of the engine 1 and the shaft 21 are coupled to each other via the first spline 55*a*.

Figure 4:
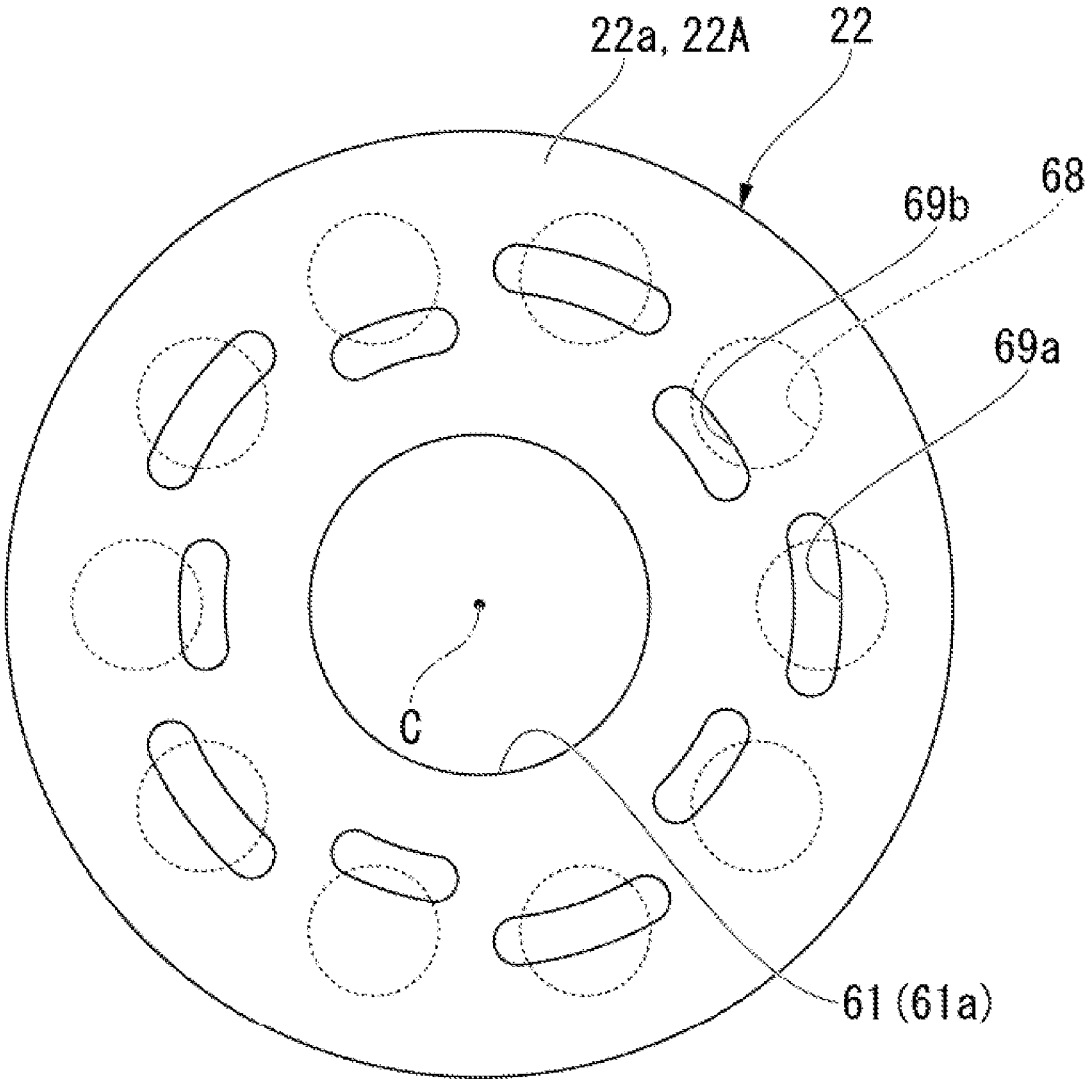
FIG. 4 schematically illustrates an end surface of an end portion of a cylinder block according to the first embodiment of the invention.

FIG. 4 schematically illustrates an end surface 22A of an end portion 22*a* of the cylinder block 22. As shown in FIGS. 3 and 4, the cylinder block 22 is formed in a columnar shape. A through hole 61 into which the shaft 21 can be inserted or press-fitted is formed in the radial center of the cylinder block 22. A spline 61*a* is formed on an inner wall surface of the through hole 61. The spline 61*a* and the second spline 51*a* of the rotational shaft body 51 are coupled to each other. The shaft 21 and the cylinder block 22 rotate together via the splines 61*a* and 51*a*, respectively. The cylinder block 22 is supported in the axial direction by a static pressure of hydraulic oil between the cylinder block 22 and the valve plate 43 described later.

In the cylinder block 22, a recess 63 is formed in a portion extending from about the center of the through hole 61 in the axial direction to the end portion 22*a* on the bottom wall 28 side such that the recess surrounds the circumference of the shaft 21. A through hole 64 that axially penetrates the cylinder block 22 is formed in a portion of the inner wall surface between the center of the through hole 61 in the axial direction and the end on the front flange 26 side. A spring 65 and retainers 66*a* and 66*b* are disposed in the recess 63. The connecting member 67 is disposed in the through hole 64 so as to be movable in the axial direction.

A plurality of cylinder chambers 68 are formed in the cylinder block 22 and they are arranged such that they surround the shaft 21. The plurality of cylinder chambers 68 are arranged at equal intervals along the circumferential direction on a predetermined pitch circle concentric with the central axis C. The cylinder chamber 68 is formed in a bottomed cylindrical shape extending along the axial direction. A side of the cylinder chamber 68 closer to the front flange 26 is open, and a side of the cylinder chamber 68 closer to the bottom wall 28 is closed. In the end portion 22*a* of the cylinder block 22, an outer peripheral communication hole 69*a* or an inner peripheral communication hole 69*b* is formed at a position corresponding to each cylinder chamber 68 so that the cylinder chamber 68 and the outside of the cylinder block 22 are communicated with each other through the communication hole.

Figure 5:
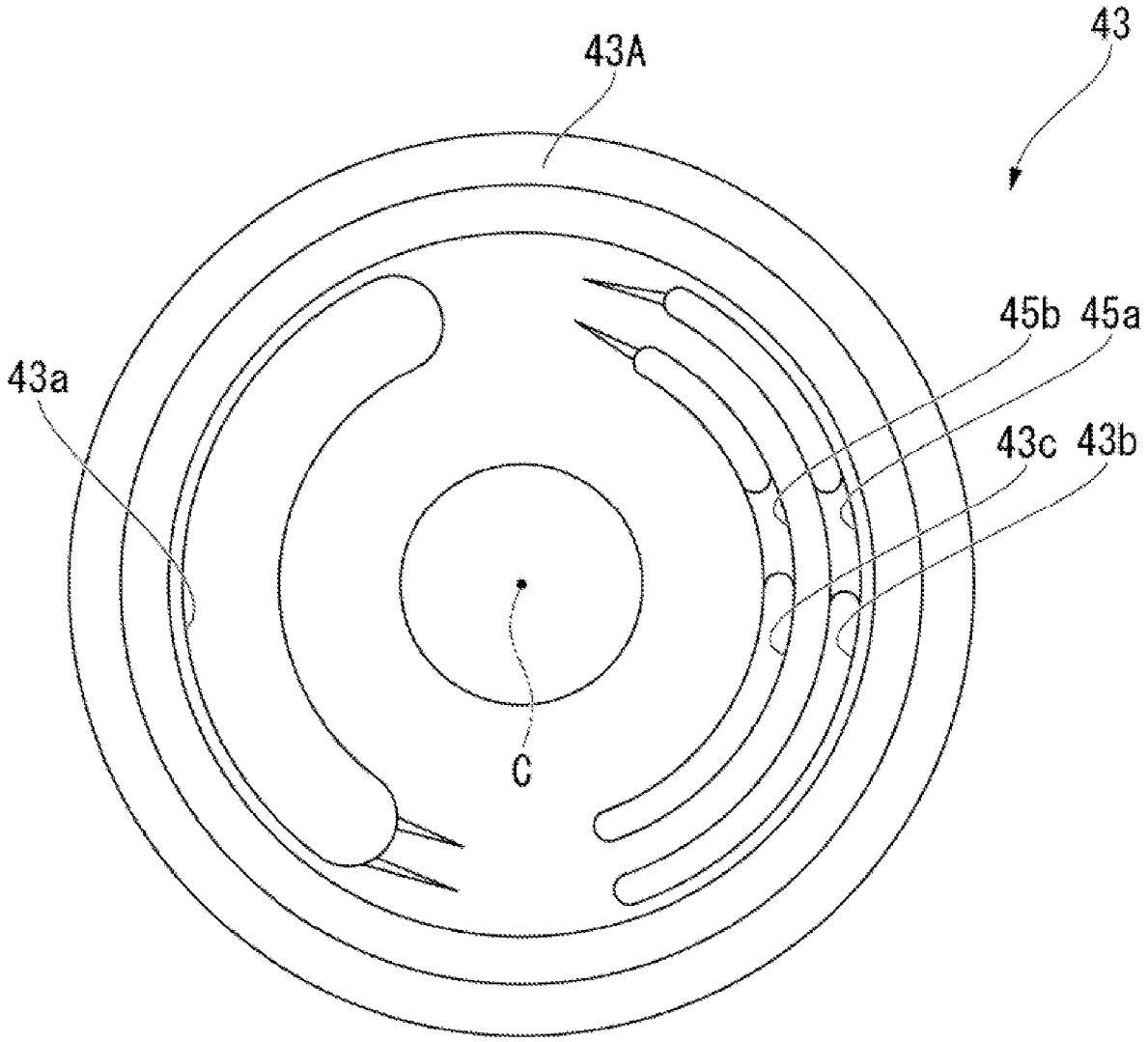
FIG. 5 schematically illustrates a first end surface of a valve plate according to the first embodiment of the invention.

FIG. 5 schematically illustrates an end surface (first end surface) 43A of the valve plate 43 situated closer to the cylinder block 22. As shown in FIGS. 3 to 5, the valve plate 43 is formed in a disk shape. The valve plate 43 is disposed between the end surface 22A of the end portion 22*a* of the cylinder block 22 and the inner surface 28*a* of the bottom wall 28 of the casing main body 25. The valve plate 43 is fixed to the bottom wall 28 of the casing main body 25. The valve plate 43 remains stationary relative to the casing main body 25 even when the cylinder block 22 and the shaft 21 rotate about the central axis C.

In the valve plate 43, a supply port 43*a* that penetrates the valve plate 43 in the thickness direction and is aligned with the outer peripheral communication holes 69*a* and the inner peripheral communication holes 69*b* of the cylinder block 22 to communicate with these communication holes is formed. The supply port 43*a* is formed, for example, in an arcuate elongated hole shape having a predetermined angle range around the central axis C. Each cylinder chamber 68 is communicated with the first communication passage 36 formed in the casing main body 25 via the supply port 43*a* of the valve plate 43 and the outer peripheral communication hole 69*a* or the inner peripheral communication hole 69*b* of the cylinder block 22 as they are aligned with each other.

The valve plate 43 has a plurality of outer peripheral discharge ports (an example of an outlet port in claims) 43*b* that are aligned and communicate with the outer peripheral communication holes 69*a* in the cylinder block 22 to communicate therewith, and a plurality of inner peripheral outlets (an example of the outlet port in claims) 43*c* that communicate with the inner peripheral communication holes 69*b* in the cylinder block 22. The inner peripheral outlets 43*c* are situated radially inside the outer peripheral outlets 43*b*. The communication holes 69*a* and 69*b* are formed such that they penetrate the valve plate 43 in the thickness direction. Each of the outer peripheral outlet port 43*b* and the inner peripheral side discharge port 43*c* is formed in, for example, an arcuate elongated hole shape having a predetermined angle range around the central axis C.

The plurality of outer peripheral outlet ports 43*b* are formed on a first pitch circle concentric with the central axis C in first end surface 43A. The plurality of outer peripheral outlet ports 43*b* are formed such that they communicate with an arc-shaped outer peripheral concave portion 45*a* formed on the first pitch circle in the first end surface 43A.

The plurality of inner peripheral outlet ports 43*c* are formed on a second pitch circle smaller than the first pitch circle concentric with the central axis C in the first end surface 43A. The plurality of inner peripheral outlet ports 43*c* are formed such that they communicate with an arc-shaped inner peripheral concave portion 45*b* formed on the second pitch circle in the first end surface 43A. The diameter of the first pitch circle is close to the diameter of a predetermined pitch circle that corresponds to the plurality of cylinder chambers 68 in the cylinder block 22, rather than the diameter of the second pitch circle. The diameter of the first pitch circle is, for example, slightly smaller than the diameter of the predetermined pitch circle for the plurality of cylinder chambers 68.

Each cylinder chamber 68 and the third communication passage 44*a* formed in the casing main body 25 communicate with each other through the outer peripheral outlet port 43*b* of the valve plate 43 and the outer peripheral communication hole 69*a* of the cylinder block 22. Each cylinder chamber 68 and the fourth communication passage 44*b* formed in the casing main body 25 communicate with each other through the inner peripheral outlet port 43*c* of the valve plate 43 and the inner peripheral communication hole 69*b* of the cylinder block 22.

The valve plate 43 is fixed to the casing main body 25. Thus the rotation of the cylinder block 22 can switch between supply of hydraulic oil to each cylinder chamber 68 from the first inlet passage 32 via the valve plate 43 and discharge of hydraulic oil from each cylinder chamber 68 to the first outlet passage 33*a* or the second outlet passage 33*b*.

The piston 71 is housed in each cylinder chamber 68 of the cylinder block 22, and the piston 71 rotates such that it orbits around the central axis C of the shaft 21 as the shaft 21 and the cylinder block 22 rotate. The end portion of the piston 71 on the front flange 26 side includes a spherical convex portion 72 integrally formed therewith. A recess 73 for storing hydraulic oil in the cylinder chamber 68 is formed in the piston 71. Reciprocation of the piston 71 is associated with the supply and discharge of hydraulic oil to and from the cylinder chamber 68.

When the piston 71 moves outward from the cylinder chamber 68, hydraulic oil is introduced into the cylinder chamber 68 from the first inlet passage 32 via the first communication passage 36 and the supply port 43*a*. When the piston 71 recedes into the cylinder chamber 68, the hydraulic oil is discharged from the cylinder chamber 68 through the outer peripheral communication hole 69*a*, the outer peripheral outlet port 43*b*, the third communication passage 44*a*, and the first outlet passage 33*a*. The hydraulic oil is discharged from the cylinder chamber 68 also through the inner peripheral communication hole 69*b*, the inner peripheral outlet port 43*c*, the fourth communication passage 44*b*, and the second outlet passage 33*b*.

The spring 65 disposed in the recess 63 of the cylinder block 22 is, for example, a coil spring. The spring 65 is compressed between the two retainers 66*a* and 66*b* in the recess 63. The spring 65 generates a biasing force in a direction of extension by its elastic force. The biasing force of the spring 65 is transmitted to the connecting member 67 via the retainer 66*b* among the two retainers 66*a* and 66*b*. The biasing force of the spring 65 is transmitted to a pressing member 75 via the connecting member 67. The pressing member 75 is fitted onto an outer peripheral surface of the rotational shaft main body 51 at a position closer to the front flange 26 than the connecting member 67.

The swash plate 23 is provided on an inner surface 26*a* of the front flange 26 facing the casing body 25. The swash plate 23 is tiltable relative to the front flange 26. Since the swash plate 23 is tilted relative to the front flange 26, displacement of each piston 71 in the axial direction is restricted. An insertion hole 76 through which the shaft 21 can be inserted is formed in the swash plate 23 at the radial center thereof. The swash plate 23 has a flat sliding surface 23*a* on the cylinder block 22 side.

A plurality of shoes 77 movable on the sliding surface 23*a* are attached to the convex portions 72 of the pistons 71. A spherical concave portion 77*a* is formed on a surface of each shoe 77 to receive the convex portion 72 such that it corresponds to the shape of the convex portion 72. The convex portion 72 of the piston 71 is fitted into an inner wall surface of the concave portion 77*a*. The shoe 77 is rotatably coupled to the convex portion 72 of the piston 71. A shoe holding member 78 integrally holds each shoe 77. The pressing member 75 contacts the shoe holding member 78 and pushes the shoe holding member 78 toward the swash plate 23. The shoe 77 moves so as to follow the sliding surface 23*a* of the swash plate 23. The angle of the swash plate 23 is controlled by the swash plate control actuator 14 (see FIG. 2).

As described above, the main pump 15 has the single swash plate 23 that controls the amount of the hydraulic oil discharged from the cylinder block 22, and the valve plate that divides the hydraulic oil discharged from the cylinder block 22 into a plurality of flows. The single swash plate 23 controls the discharge amount of hydraulic oil from the two discharge ports, which are the first discharge port 41 and the second discharge port 42, of the main pump 15. That is, in the main pump 15, the swash plate angle of the single swash plate 23 is changed and controlled by the swash plate control actuator 14, so that the displacement amount (displacement volume) changes, and accordingly the flow rate of the hydraulic oil discharged from the first discharge port 41 and the second discharge port 42 is changed.

Pilot Pump

At an end of the first inlet passage 32 closer to the shaft 21, formed is the first communication passage 36 that communicatively connects the first inlet passage 32 and the inner surface 28*a* of the bottom wall 28. The first communication passage 36 communicatively connects the first inlet passage 32 and the supply port 43*a* of the valve plate 43. At the end of the first inlet passage 32 closer to the shaft 21, also formed is the second communication passage 37 that communicatively connects the first inlet passage 32 and the outer surface 28*b* of the bottom wall 28. The second communication passage 37 connects the first inlet passage 32 and the second inlet passage 82, which will be described later, of the pilot pump 16.

The pilot pump 16 is, for example, a gear pump including a gear casing 81, a drive gear, and a driven gear (not shown). The rectangular parallelepiped gear casing 81 is disposed on the outer surface 28*b* of the bottom wall 28 of the main casing 20. The second inlet passage 82 communicatively connected to the second communication passage 37 of the main casing 20 is formed in the wall surface 81*a* that overlaps with the main casing 20 of the gear casing 81. The second inlet passage 82 communicatively connects the inside and the outside of the wall surface 81*a* of the gear casing 81.

A coupling insertion hole 83 is formed in the wall surface 81*a* of the gear casing 81 at a position corresponding to the rotational shaft insertion hole 29 of the main casing 20. An end portion of the coupling 57 situated closer to the pilot pump 16 protrudes into the gear casing 81 through the coupling insertion hole 83. A first side wall surface 81*b* of the gear casing 81 faces in the same direction as the first side surface 28*c* of the main casing 20 in which the inlet port 32*a* is formed. A second side wall surface 81*c* faces the same direction as the second side surface 28*d* of the main casing 20 in which the outlet ports of the first outlet passage 33*a* and the second outlet passage 33*b* are formed.

As shown in FIGS. 2 and 3, a third outlet passage (not shown) is formed in the second side wall surface 81*c* of the gear casing 81. The third outlet passage of the gear casing 81 opens in the second side wall surface 81*c*. An outlet of the third outlet passage in the gear casing 81 and outlets of the first outlet passage 33*a* and the second outlet passage 33*b* in the main casing 20 are formed in the second side wall surface 81*c* and the second side surface 28*d* respectively that face the same direction. A third discharge port 59 is formed at the outlet of the third outlet passage. That is, the third discharge port 59 is arranged such that it faces the same direction as the first discharge port 41 and the second discharge port 42.

The drive gear and the driven gear of the pilot pump 16 are rotatably supported in the gear casing 81 and mesh with each other. The drive gear is connected to the coupling 57 that projects from the main casing 20 through the coupling insertion hole 83. The rotational force of the shaft 21 in the main pump 15 is transmitted to the drive gear via the coupling 57. Since the driven gear meshes with the drive gear, it rotates in synchronization with the drive gear.

As shown in FIGS. 1 and 2, the plurality of actuators 3*a* to 3*d* are connected to the first discharge port 41 and the second discharge port 42 via the control valve 4 and the like. The plurality of actuators 3*a* to 3*d* are driven by a first hydraulic oil (first pressure oil, an example of a discharged fluid in claims) discharged from the first discharge port 41 of the main pump 15 and a second hydraulic oil (second pressure oil, an example of the discharged fluid in claims) discharged from the second discharge port 42. The actuator 3*a* is, for example, a hydraulic motor that rotates the slewable upper structure 101 101. The actuator 3*b* is, for example, a hydraulic cylinder that swingably moves the boom 104. The actuator 3*c* is, for example, a hydraulic cylinder that swingably moves the arm 105. The actuator 3*d* is, for example, a hydraulic cylinder that swingably moves the bucket 106.

The control valve 4 is coupled to the first discharge port 41 and the second discharge port 42 of the main pump 15 via a first pressure oil supply passage (an example of a discharge flow passage in claims) 120 and a second pressure oil supply passage (an example of the discharge flow passage in claims) 121. The control valve 4 incorporates a plurality of open-center type flow control valves 15*a* to 15*d*. The flow control valves 15*a* to 15*d* control the flow rates of the first hydraulic oil and the second hydraulic oil supplied from the first discharge port 41 and the second discharge port 42 to the plurality of actuators 3*a* to 3*d*.

The plurality of pilot valves 5*a* to 5*d* are coupled to the third discharge port 59 of the pilot pump 16 via the third pressure oil supply passage 122. The pilot valves 5*a* to 5*d* generate pilot pressures for controlling the flow control valves 15*a* to 15*d* by a third hydraulic oil (third pressure oil) discharged from the third discharge port 59 of the pilot pump 16.

The plurality of pilot valves 5*a* to 5*d* each include an operating lever (not shown). The pilot valves 5*a* to 5*d* each selectively operate according to operation direction of the corresponding operating lever and generate a pilot pressure depending on selection of the operation lever by using the third pressure oil (discharge pressure of the pilot pump 16) in the third pressure oil supply passage 122 as a source pressure. This pilot pressure is outputted to the corresponding flow rate control valves 15 to 15 in the control valve 4 via a pilot oil passage to switch the corresponding flow control valves 15 to 15*d*.

To move the bucket 106 swingably by the hydraulic cylinder of the actuator 3*d*, for example, a second hydraulic pressure (second pressure oil) is delivered to the actuator 3*d* via the second pressure oil supply passage 121 from the second discharge port 42 of the main pump 15. At the same time, a first hydraulic pressure (first pressure oil) guided from the first discharge port 41 of the main pump 15 to the first pressure oil supply passage 120 returns to the tank 35.

A middle portion of the first pressure oil supply passage 120 is communicatively connected to a middle portion of the second pressure oil supply passage 121 by a measurement communication passage 123. In the measurement communication passage 123, a first orifice 124 is provided at a portion connected to the first pressure oil supply passage 120 and a second orifice 125 is provided at a portion connected to the second pressure oil supply passage 121. A single pressure gauge 11 is connected between the first orifice 124 and the second orifice 125 in the measurement communication passage 123 via the pressure measurement passage 126. The pressure measurement passage 126 has a third orifice 132. Alternatively the third orifice 132 may not be provided in the pressure measurement passage 126

The first hydraulic oil is discharged from the first discharge port 41 of the main pump 15 to the first pressure oil supply passage 120, and the second hydraulic oil is discharged from the second discharge port 42 of the main pump 15 to the second pressure oil supply passage 121. The first hydraulic oil is guided through the first orifice 124 of the measurement communication passage 123 to a merging point (an example of a merging point in claims) 123*a* in the measurement communication passage 123. The second hydraulic oil is guided to the merging point 123*a* of the measurement communication passage 123 through the second orifice 125 of the measurement communication passage 123. The first hydraulic oil and the second hydraulic oil are merged at the merging point 123*a*, and the merged first hydraulic oil and the second hydraulic oil are guided to the pressure gauge 11 of the torque control unit 6 via the pressure measuring passage 126.

Torque Control Unit

The pressure gauge 11, a control unit 12, a proportional solenoid valve 13, and a swash plate control actuator 14 included in the torque control unit 6 will be now described. The first hydraulic oil and the second hydraulic oil merged at the merging point 123*a* are guided to the pressure measurement passage 126, and the pressure gauge 11 measures (an example of detection in claims) a pressure of the first hydraulic oil and the second hydraulic oil combined (an example of a combined pressure in claims) to obtain a pressure value. Hereinafter, the pressure of the first hydraulic oil and the second hydraulic oil merged to each other may be referred to as an "intermediate pressure." The pressure value obtained by the pressure gauge 11 is transmitted to the control unit 12 as an electric signal. In the first embodiment, for example, a mechanical device for measuring pressure (that is, the pressure gauge 11) is used as a pressure detection unit. However the present invention is not limited to this. As another example, a pressure sensor that electrically measures the pressure using a strain gauge may be employed as the pressure detection unit.

The control unit 12 calculates an average pressure based on the transmitted pressure values, and then calculates a pump absorption torque from the average pressure. Further, the control unit 12 determines a maximum pump absorption horsepower (that is, a swash plate angle of the swash plate 23) from, for example, an external environment and a revolution speed of the engine 1 based on the calculated pump absorption torque. Further, the control unit 12 transmits the determined swash plate angle of the swash plate 23 to the proportional solenoid valve 13 as an electric signal.

The proportional solenoid valve 13 activates the swash plate control actuator 14 based on the swash plate angle of the swash plate 23 determined by the control unit 12. Specifically, an input port 127 of the proportional solenoid valve 13 is coupled to the third pressure oil supply passage 122 via a first pilot passage 128, and an output port 129 of the proportional solenoid valve 13 is coupled to the swash plate control actuator 14 via a second pilot passage 130. The third hydraulic oil discharged from the pilot pump 16 is delivered to the input port 127 via the third pressure oil supply passage 122 and the first pilot passage 128.

Further, when the proportional solenoid valve 13 is activated, the third hydraulic oil (pilot oil) delivered to the input port 127 is then supplied to the swash plate control actuator 14 via the output port 129 and the second pilot passage 130. Since the proportional solenoid valve 13 operates based on the swash plate angle of the swash plate 23 determined by the control unit 12, the pilot oil of the third hydraulic oil discharged from the pilot pump 16 is delivered to the swash plate control actuator 14.

The swash plate control actuator 14 is, for example, a control cylinder that operates based on the pilot oil delivered through the proportional solenoid valve 13 and in which a piston (not shown) reciprocates thereinside. By operating the swash plate control actuator 14, the swash plate 23 is controlled to be set at the swash plate angle determined by the control unit 12.

Operation of Hydraulic Drive Device

Next, a description is given of an operation of the hydraulic drive device 110. The first hydraulic oil is discharged from the first discharge port 41 of the main pump 15 to the first pressure oil supply passage 120, and the discharged first hydraulic oil passes through the first orifice 124. Further, the second hydraulic oil is discharged from the second discharge port 42 of the main pump 15 to the second pressure oil supply passage 121, and the discharged second hydraulic oil passes through the second orifice 125.

The first hydraulic oil and the second hydraulic oil merge at the merging point 123*a* between the first orifice 124 and the second orifice 125 in the measurement communication passage 123. The merged hydraulic oil is delivered to the pressure gauge 11 through the pressure measurement passage 126. The pressure gauge 11 detects intermediate pressures P1 and P2 of the merged first hydraulic oil and the second hydraulic oil.

The intermediate pressure P1 is an intermediate pressure including the first hydraulic oil as a main component among the merged first hydraulic oil and the second hydraulic oil. The intermediate pressure P2 is an intermediate pressure including the second hydraulic oil as a main component among the merged first hydraulic oil and the second hydraulic oil. Pressure waveforms of the intermediate pressure P1 and the intermediate pressure P2 change regularly. The intermediate pressures P1 and P2 detected by the pressure gauge 11 are electrically transmitted to the control unit 12.

The control unit 12 calculates an average pressure Pm based on the intermediate pressures P1 and P2 measured by the pressure gauge 11 to obtain the average of the intermediate pressures (P1, P2).

$$\text{Average pressure } Pm=(P1+P2)/2$$

Then, based on the calculated average pressure Pm, $$\text{Pump absorption torque}=Pm\times(V1+V2)/(2\pi\times\eta)$$

is calculated to obtain the pump absorption torque, where

Pump absorption torque: Torque for driving the main pump 15

V1: Displacement of the first discharge port 41 of the main pump 15

V2: Displacement of the second discharge port 42 of the main pump 15

η: Efficiency

Based on the calculated pump absorption torque, $$\text{the swash plate angle of swash plate 23}=V1+V2$$

is determined. Further, the control unit 12 derives the maximum absorption horsepower of the pump from the external environment and the revolution speed of the engine 1.

An electric signal based on the information determined by the control unit 12 is transmitted to the proportional solenoid valve 13. The proportional solenoid valve 13 operates based on the transmitted electric signal. When the proportional solenoid valve 13 operates, the pilot oil discharged from the pilot pump 16 is delivered to the swash plate control actuator 14 based on the swash plate angle of the swash plate 23 determined by the control unit 12. The swash plate control actuator 14 operates based on the pilot oil delivered from the proportional solenoid valve 13, and the piston (not shown) reciprocates. By operating the swash plate control actuator 14, the swash plate 23 is controlled to be set at the swash plate angle determined by the control unit 12. In this way, it is possible to accurately perform, for example, a horsepower control, a total horsepower control, control, a control of air conditioner, etc. a horsepower reduction control, and any other controls by controlling the swash plate angle of the swash plate 23 using the proportional solenoid valve 13.

As described above, according to the hydraulic drive device 110 of the first embodiment, the main pump 15 is a split flow pump, and the hydraulic oil discharged from the cylinder block 22 is divided into the first hydraulic oil and the second hydraulic oil by the valve plate 43. The first hydraulic oil and the second hydraulic oil divided by the valve plate 43 are merged, and the intermediate pressures P1 and P2 of the merged first hydraulic oil and the second hydraulic oil can be measured by the single pressure gauge 11. Thus, it is not necessary to provide two or more pressure gauges, and increase of the cost of the hydraulic drive device 110 is prevented.

Further, the intermediate pressures P1 and P2 of the merged first hydraulic oil and the second hydraulic oil are measured with the single pressure gauge 11, and the control unit 12 calculates the average pressure based on the measured pressure value. Further, the control unit 12 can calculate the pump absorption torque corresponding to the angle of the swash plate which is the stroke volume suitable for the average pressure. Therefore, the control unit 12 can determine the maximum pump absorption horsepower (that is, the swash plate angle of the swash plate 23) based on the calculated pump absorption torque, for example, from the external environment or the revolution speed of the engine 1.

Thereby, based on the pump maximum absorption horsepower determined by the control unit 12, for example, the discharge flow rate can be controlled to the pump maximum absorption horsepower determined by the control unit 12 based on the swash plate angle calculated from the average pressure. In this way, since the proportional solenoid valve 13 is provided in the torque control unit 6, the swash plate angle of the swash plate 23 can be electronically controlled and the pump absorption horsepower of the split flow main pump 15 can be accurately controlled.

The intermediate pressures P1 and P2 of the merged hydraulic oil change regularly. By detecting the intermediate pressures P1 and P2 with the pressure gauge 11, the number of revolutions and the revolution speed of the main pump 15 can be detected based on a peak in pressure waveforms of the intermediate pressures P1 and P2.

In the above first embodiment, the hydraulic oil discharged from the cylinder block 22 is divided into the first hydraulic oil and the second hydraulic oil by the valve plate 43 has been described as one example, but the invention is not limited to this. As another example, the hydraulic oil discharged from the cylinder block 22 may be divided into three or more hydraulic oils by the valve plate 43.

Hydraulic drive devices 140, 150, and 160 according to second to fourth embodiments will be hereunder described with reference to FIGS. 6 to 13. In the second to fourth embodiments, the same or similar components or elements as those of the hydraulic drive system 110 of the first embodiment are given the same reference numerals, and detailed description thereof will be omitted.

Second Embodiment

Figure 6:
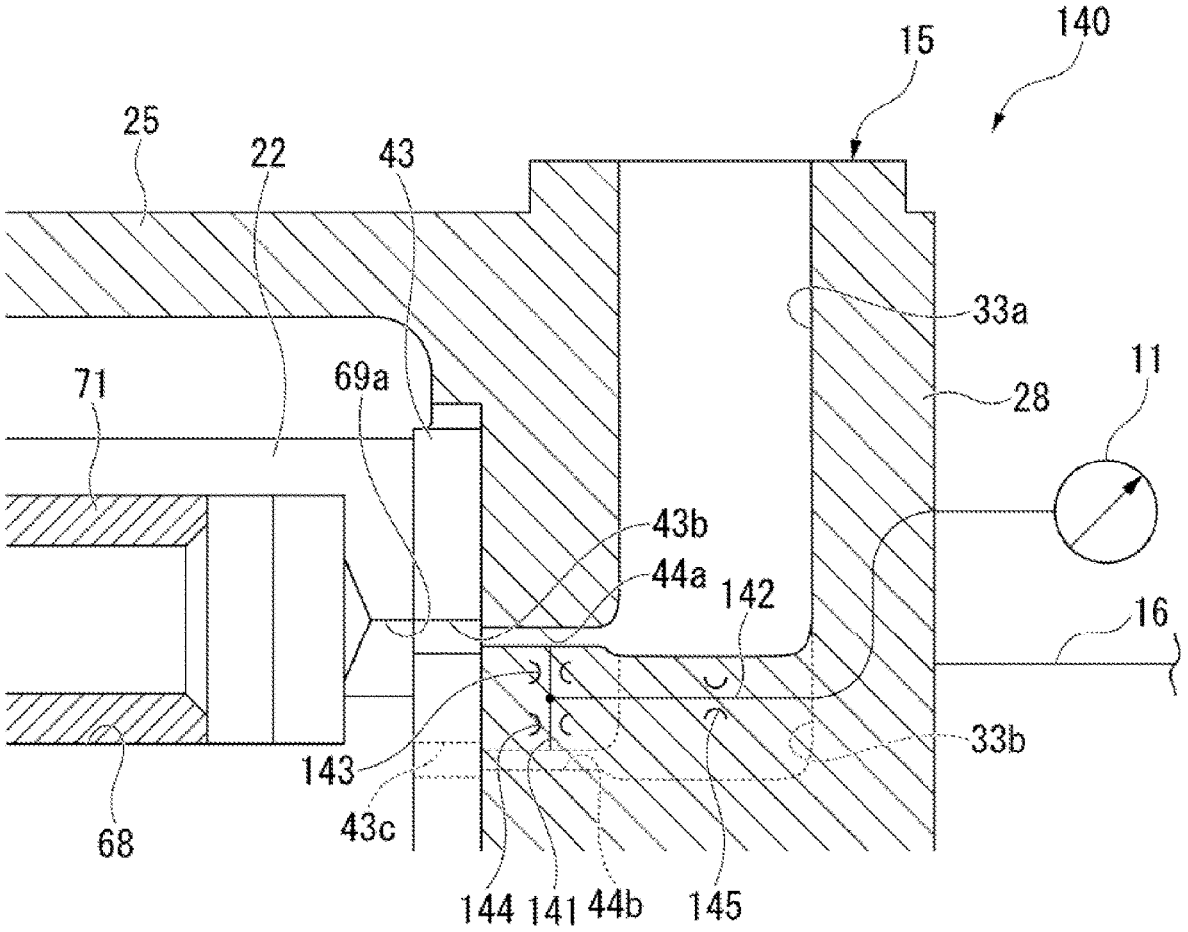
FIG. 6 is an enlarged sectional view of essential parts of a hydraulic drive device according to a second embodiment of the invention.

FIG. 6 is an enlarged sectional view of essential parts of a hydraulic drive device (an example of a fluid pressure drive device in claims) 140 according to the second embodiment of the invention. As shown in FIGS. 2 to 6, the hydraulic drive device 140 has the measurement communication passage (an example of a passage that communicatively connects a plurality of outlet ports of the valve plate and a passage that communicatively connects outlet passages of the casing) 141 in the bottom wall 28 of the casing main body 25. The measurement communication passage 141 is coupled to the single pressure gauge 11 via a pressure measurement passage 142. Specifically, the third communication passage 44*a* and the fourth communication passage 44*b* are formed in the bottom wall 28 of the casing main body 25. The first hydraulic oil divided by the valve plate 43 is guided to the third connecting passage 44*a*. The second hydraulic oil divided by the valve plate 43 is guided to the fourth passage 44*b*.

A middle portion of the third communication passage 44*a* is communicatively connected to a middle portion of the fourth communication passage 44*b* by the measurement communication passage 141. That is, the outer peripheral outlet port 43*b* and the inner peripheral outlet port 43*c* are connected to each other by the measurement passage 141 via the third communication passage 44*a* and the fourth communication passage 44*b*. The measurement communication passage 141 extends in the radial direction. In the measurement communication passage 141, the first orifice 143 is provided at a portion connected to the third pressure communication passage 44*a* and the second orifice 144 is provided at a portion connected to the third pressure communication passage 44*a*. A single pressure gauge 11 is connected between the first orifice 143 and the second orifice 144 in the measurement communication passage 141 via the pressure measurement passage 142. The pressure measurement passage 142 has a third orifice 145. Alternatively the third orifice 145 may not be provided in the pressure measurement passage 142

As described above, according to the hydraulic drive device 140 of the second embodiment, similar to the hydraulic drive device 110 of the first embodiment, the hydraulic oil discharged from the cylinder block 22 is divided into the first hydraulic oil and the second hydraulic oil by the valve plate 43. The first hydraulic oil and the second hydraulic oil divided by the valve plate 43 are merged, and the intermediate pressures (P1, P2) of the merged first hydraulic oil and the second hydraulic oil can be measured by the single pressure gauge 11. Therefore, for example, the control unit 12 can calculate the average pressure based on the measured pressure values, and the control unit 12 can further calculate the pump absorption torque from the average pressure. Moreover, the control unit 12 can determine the maximum pump absorption horsepower (that is, the swash plate angle of the swash plate 23) from, for example, an external environment and the revolution speed of the engine 1 based on the calculated pump absorption torque.

Based on the pump maximum absorption horsepower determined by the control unit 12, for example, the swash plate control actuator 14 is operated using the proportional solenoid valve 13 to control the swash plate 23 such that it moves at the swash plate angle determined by the control unit 12 to control the discharge flow rate. In this way, since the proportional solenoid valve 13 is provided in the torque control unit 6, the swash plate angle of the swash plate 23 can be electronically controlled and the pump absorption horsepower of the split flow main pump 15 can be accurately controlled.

The intermediate pressures P1 and P2 of the merged first hydraulic oil and the second hydraulic oil can be measured by the single pressure gauge 11. Thus, similar to the hydraulic drive device 110 of the first embodiment, it is not necessary to provide two or more pressure gauges and increase of the cost of the hydraulic drive device 140 is prevented.

Further, by providing the measurement communication passage 141 in the bottom wall 28 of the casing main body 25, it is not necessary to provide the measurement communication passage 123 outside the main pump 15 as in the hydraulic drive device 110 of the first embodiment. Therefore, the configuration of the hydraulic drive device 140 can be simplified and the size of the hydraulic drive device 140 can be reduced.

Third Embodiment

Figure 7:
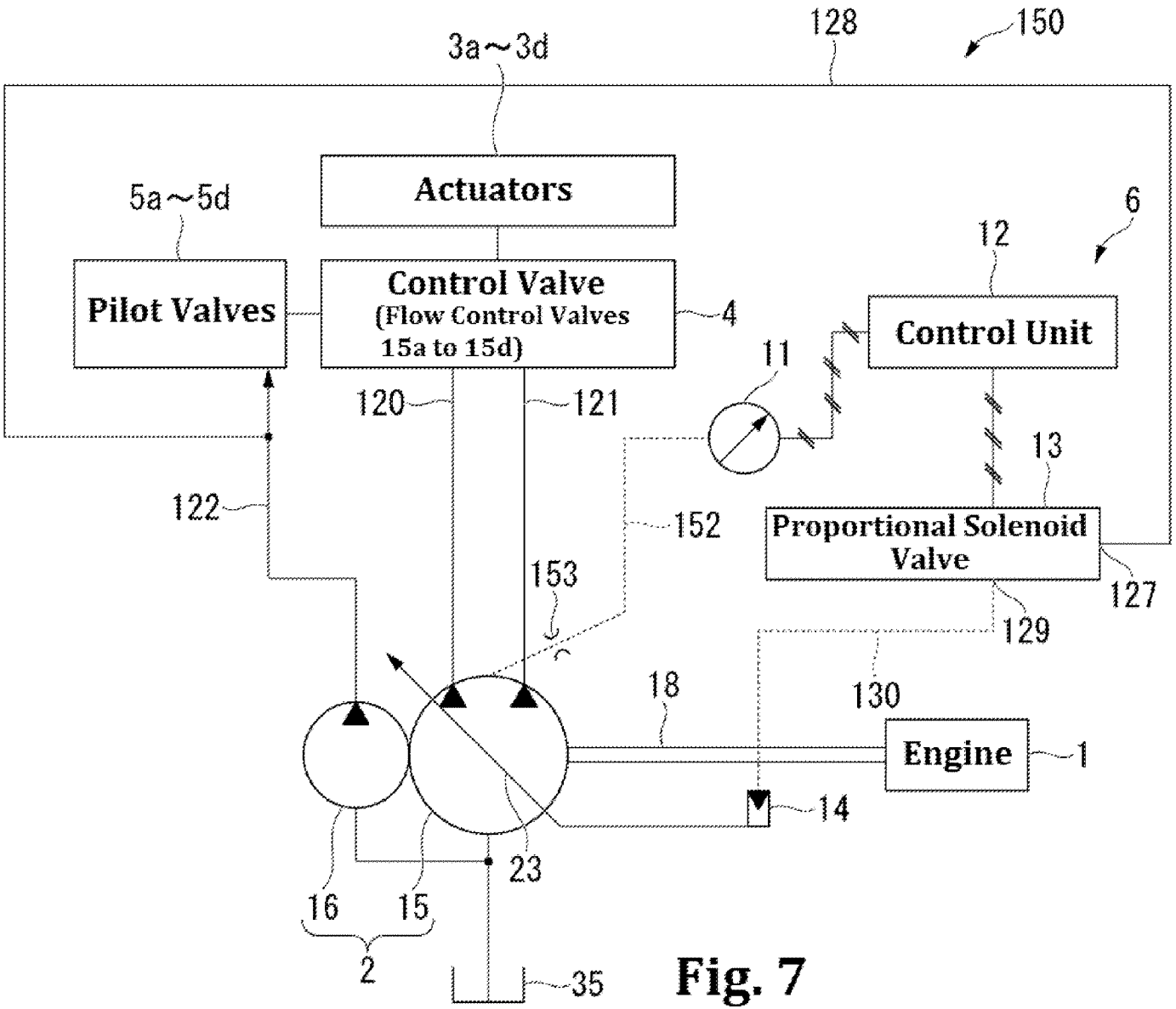
FIG. 7 schematically illustrates a hydraulic drive device according to a third embodiment of the invention.
Figure 8:
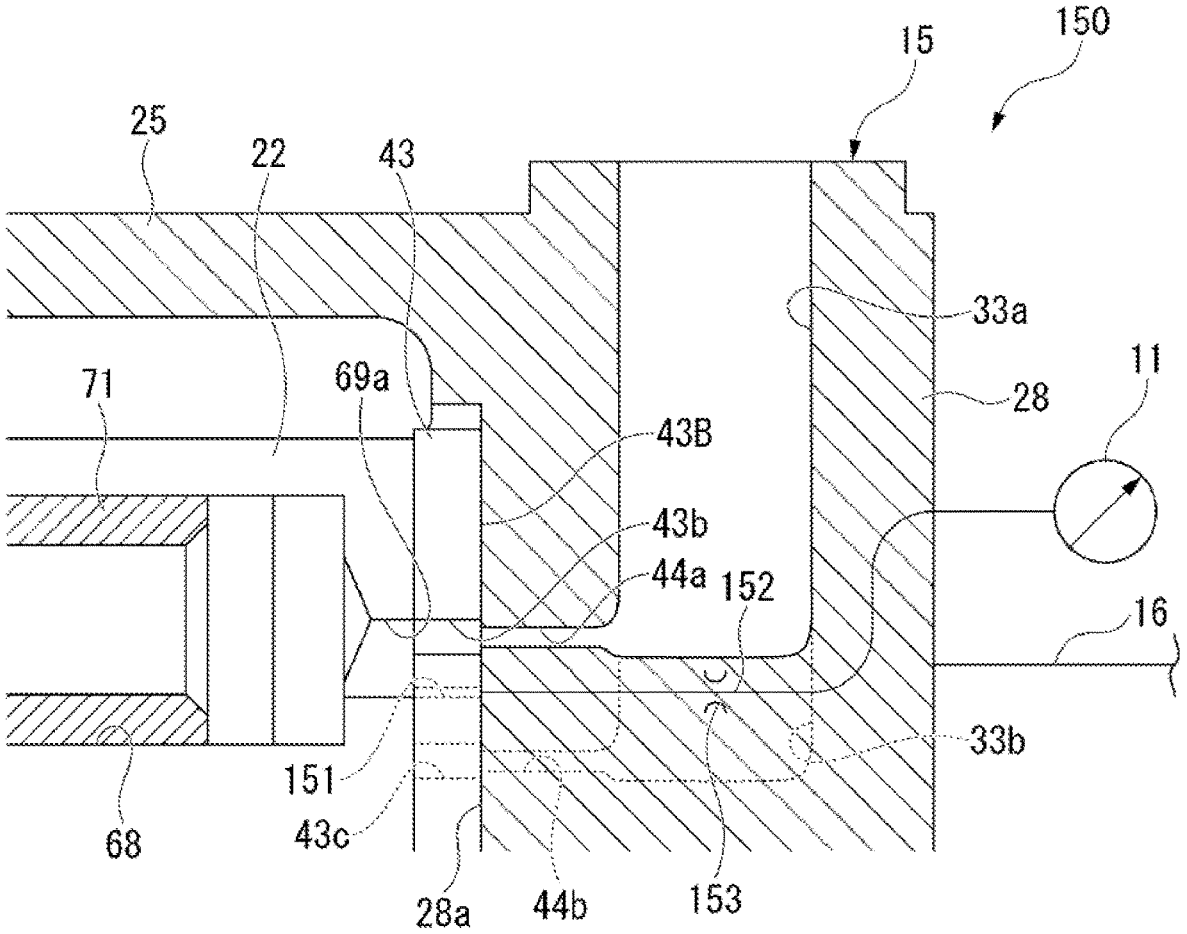
FIG. 8 is an enlarged view of essential parts of the hydraulic drive device according to the third embodiment of the invention.
Figure 9:
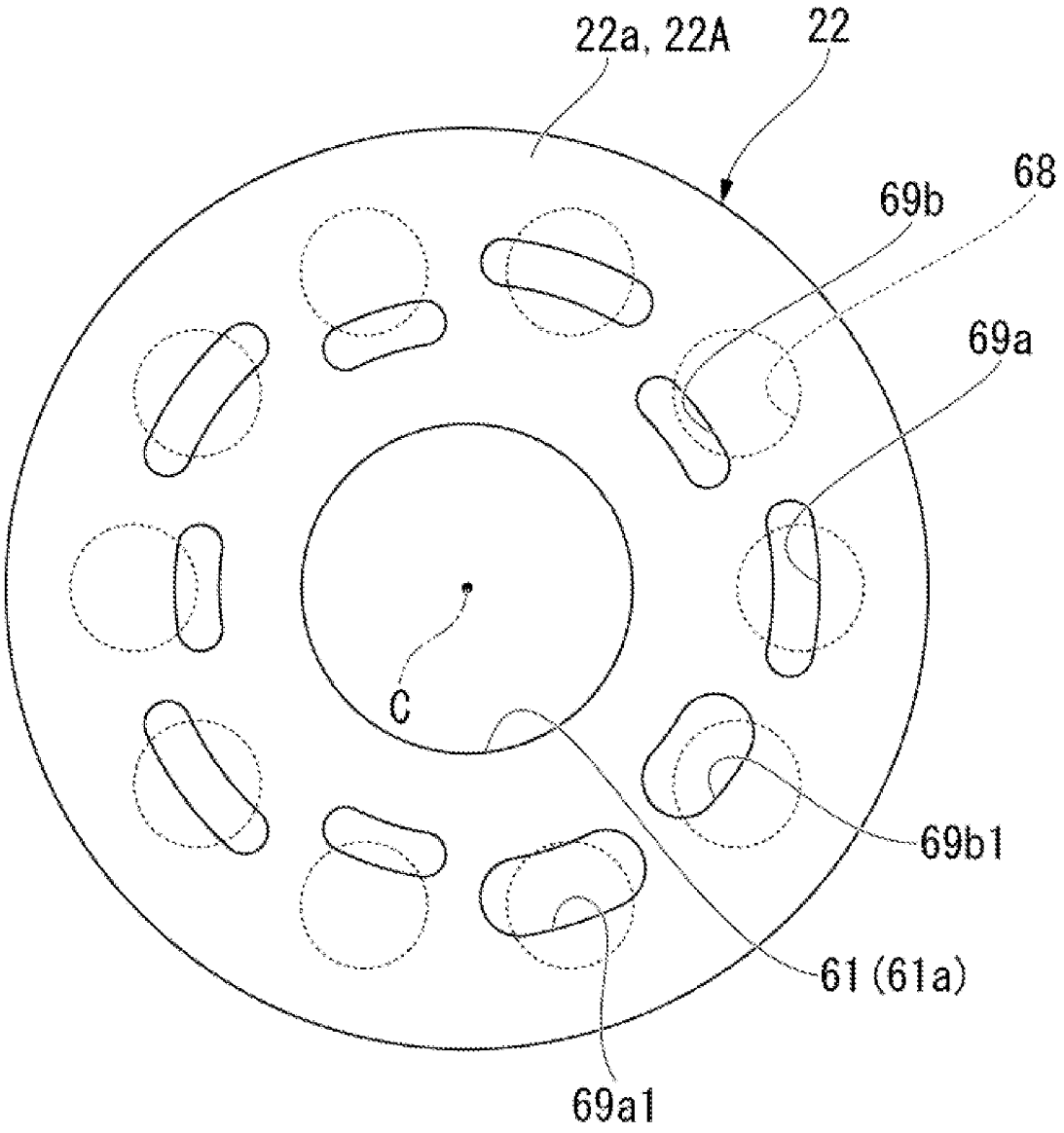
FIG. 9 schematically illustrates an end surface of an end portion of a cylinder block according to the third embodiment of the invention.
Figure 10:
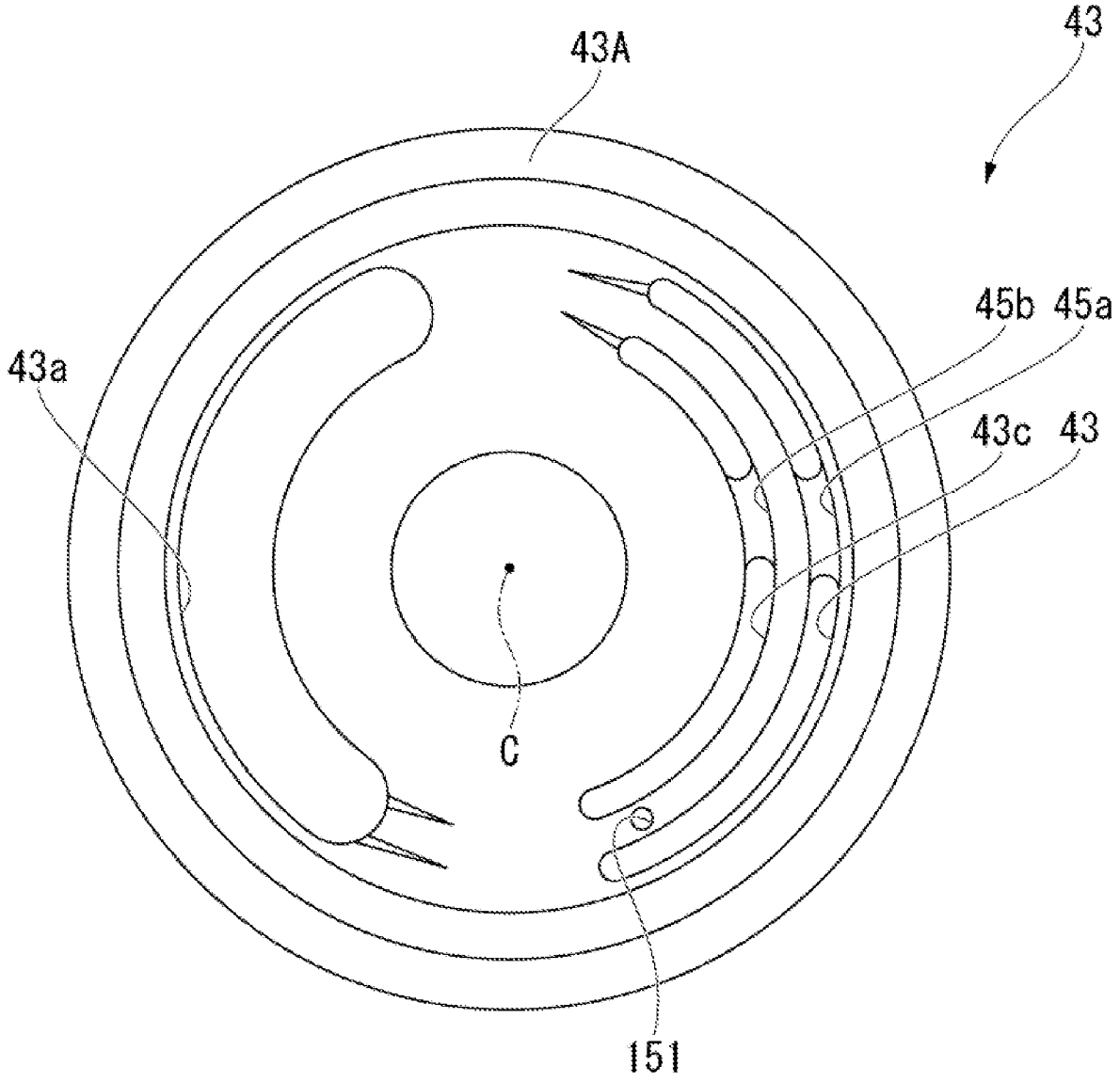
FIG. 10 schematically illustrates a first end surface of a valve plate according to the third embodiment of the invention.

FIG. 7 schematically illustrates a hydraulic drive device (an example of the fluid pressure drive device in claims) 150 according to the third embodiment of the invention. FIG. 8 is a sectional view showing essential parts of the hydraulic drive device 150. FIG. 9 schematically illustrates the end surface 22A of the end portion 22*a* of the cylinder block 22. FIG. 10 schematically illustrates an end surface (first end surface) 43A of the valve plate 43 situated closer to the cylinder block 22. As shown in FIGS. 7 to 10, in the hydraulic drive device 150, the single pressure gauge 11 is coupled to the cylinder chamber 68 of the cylinder block 22 via a pressure measurement passage 152 or the like. The pressure measurement passage 152 has an orifice 153. In FIG. 7, the orifice 153 is shown outside the main pump 1 for ease of explanation. Alternatively the orifice 153 may not be provided in the pressure measurement passage 152.

Specifically, the outer peripheral communication hole 69*a* in the end portion 22*a* of the cylinder block 22 is widened radially inward to form an outer peripheral communication hole 69*a*1. Further, the inner peripheral communication hole 69*b* in the end portion 22*a* is widened radially outward to form an inner peripheral communication hole 69*b*1. The outer peripheral communication hole 69*a*1 and the inner peripheral communication hole 69*b*1 are formed such that they overlap each other in the circumferential direction. In the third embodiment, one selected from the plurality of outer peripheral communication holes 69*a* is formed as the outer peripheral communication hole 69*a*1, and one selected from the plurality of inner peripheral side communication holes 69*b* is formed as the inner peripheral communication hole 69*b*1. However the present invention is not limited to this example. As another example, for example, two or more outer peripheral communication holes 69*a* may be formed as the outer peripheral communication holes 69*a*1, and two or more inner peripheral communication holes 69*b* may be formed as the inner peripheral communication holes 69*b*1.

A valve plate communication hole 151 penetrates the valve plate 43 in the axial direction. The valve plate communication hole 151 is formed between the outer peripheral outlet port 43*b* and the inner peripheral outlet port 43*c* in the radial direction. The valve plate communication hole 151 is formed such that it overlaps the outer peripheral communication hole 69*a*1 and the inner peripheral communication hole 69*b*1 in the circumferential direction. The first hydraulic oil and the second hydraulic oil divided by the valve plate 43 are regularly guided to the valve plate communication hole 151 from the outer peripheral communication hole 69*a*1 and the inner peripheral communication hole 69*b*1. Thus the discharge pressures P1 and P2 that change regularly are generated in the valve plate communication hole 151. The single pressure gauge 11 is connected to the valve plate communication hole 151 via the pressure measurement passage 152. The pressure gauge 11 is able to measure the discharge pressure P1 of the first hydraulic oil and the discharge pressure P2 of the second hydraulic oil alternately (separately) and regularly.

As described above, according to the hydraulic drive device 150 of the third embodiment, the discharge pressure P1 of the first hydraulic oil and the discharge pressure P2 of the second hydraulic oil divided by the valve plate 43 can be measured with the single pressure gauge 11. Therefore, similarly to the hydraulic drive device 110 of the first embodiment, the control unit 12 calculates the average pressure based on the measured discharge pressures P1 and P2 of the first hydraulic oil and the second hydraulic oil, and further calculates the pump absorption torque from the average pressure. Moreover, the control unit 12 can determine the maximum pump absorption horsepower (that is, the swash plate angle of the swash plate 23) from, for example, an external environment and the revolution speed of the engine 1 based on the calculated pump absorption torque.

Based on the pump maximum absorption horsepower determined by the control unit 12, for example, the swash plate control actuator 14 is operated using the proportional solenoid valve 13 to control the swash plate 23 such that it moves at the swash plate angle determined by the control unit 12 to control the discharge flow rate. In this way, since the proportional solenoid valve 13 is provided in the torque control unit 6, the swash plate angle of the swash plate 23 can be electronically controlled and the maximum pump absorption horsepower of the split flow main pump 15 can be accurately controlled.

The discharge pressures P1 and P2 of the first hydraulic oil and the second hydraulic oil that have been divided by the valve plate 43 can be measured by the single pressure gauge 11. Thus, similar to the hydraulic drive device 110 of the first embodiment, it is not necessary to provide two or more pressure gauges and increase of the cost of the hydraulic drive device 150 is prevented.

The outer peripheral communication hole 69*a*1, the inner peripheral communication hole 69*b*1, and the pressure measurement passage 152 are formed inside the main pump 15. Therefore, the configuration of the hydraulic drive device 150 can be simplified as compared to the hydraulic drive device 110 of the first embodiment and the size of the hydraulic drive device 150 can be reduced.

Fourth Embodiment

Figure 11:
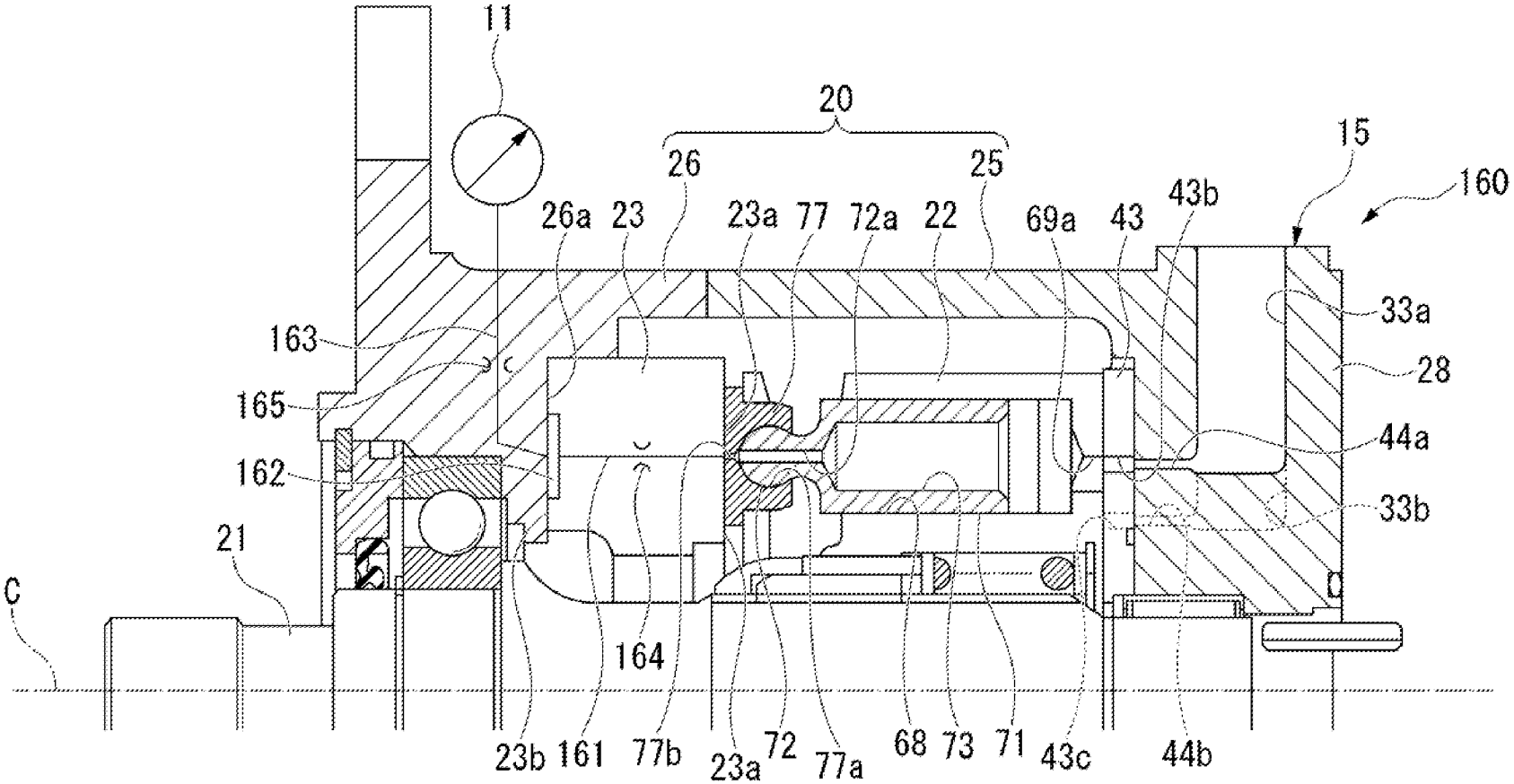
FIG. 11 schematically illustrates a hydraulic drive device according to a fourth embodiment of the invention.
Figure 12:
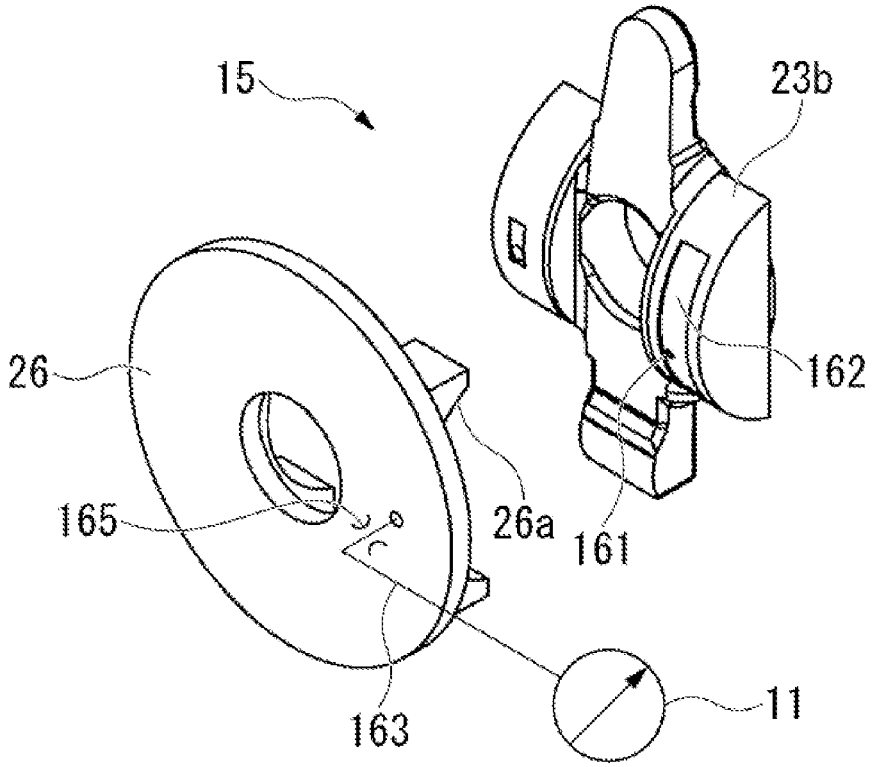
FIG. 12 is an exploded perspective view of a front flange and a swash plate according to a fourth embodiment.
Figure 13:
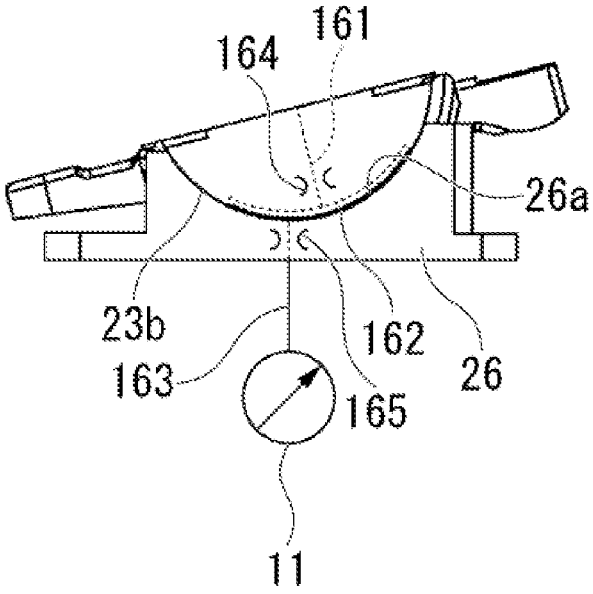
FIG. 13 is a side view of the front flange and the swash plate according to the fourth embodiment.

FIG. 11 schematically illustrates a hydraulic drive device (an example of the fluid pressure drive device in claims) 160 according to the fourth embodiment of the invention. FIG. 12 is an exploded perspective view of the front flange 26 and the swash plate 23. FIG. 13 is a side view of the front flange 26 and the swash plate 23. As shown in FIGS. 11 to 13, in the hydraulic drive device 160, the single pressure gauge 11 is connected in the recess 73 inside the piston 71 via a first pressure measurement passage 161, a second pressure measurement passage 163, and the like. The first pressure measurement passage 161 has a first orifice 164. The second pressure measurement passage 163 has a second orifice 165. In FIG. 12, the second orifice 165 is shown outside the main pump 15 for ease of explanation. An orifice may be provided in either the first pressure measurement passage 161 or the second pressure measurement passage 163. Alternatively, the orifice may not be provided in both the first pressure measurement passage 161 and the second pressure measurement passage 163.

Specifically, the recess 73 for storing the hydraulic oil in the cylinder chamber 68 is formed in the piston 71. Further, a convex portion communication hole 72*a* that communicates with the recess 73 is formed in the convex portion 72 of the piston 71. Moreover a shoe communication hole 77*b* that communicates with the convex portion communication hole 72*a* penetrates the shoe 77. The shoe communication hole 77*b* opens in the sliding surface 23*a* of the swash plate 23.

The piston 71 is regularly pulled out of the cylinder chamber 68 and the enters into the cylinder chamber 68 in accordance with rotation of the cylinder block 22 about the central axis C together with the shaft 21. When the piston 71 enters the cylinder chamber 68, the hydraulic oil in the cylinder chamber 68 is divided as the first hydraulic oil at the outer peripheral outlet port 43*b* (that is, the valve plate 43) after flowing through the outer peripheral communication hole 69*a*, and then flows in the third communication passage 44*a* and the first outlet passage 33*a* to be discharged. The hydraulic oil in the cylinder chamber 68 flows through the inner peripheral communication hole 69*b* (see FIG. 4), is subsequently divided as the second hydraulic oil at the inner peripheral outlet port 43*c* (that is, the valve plate 43), and flows through the fourth communication passage 44*b* and the second outlet passage 33*b* to be discharged. The discharge pressure of the first hydraulic oil (an example of a high-pressure side piston pressure in claims) P1 and the discharge pressure of the second hydraulic oil (an example of the high-pressure side piston pressure in claims) P2 are transmitted regularly from the recess 73 in the piston 71 to the shoe communication hole 77*b* through the convex portion communication hole 72*a*.

The swash plate 23 is provided with the first pressure measurement passage 161 and a measurement recess 162. The measurement recess 162 is defined by a curved surface 23*b* of the swash plate 23, and is formed such that it dents toward the sliding surface 23*a*. The curved surface 23*b* is slidable along the inner surface 26*a* of the front flange 26. Thus the swash plate 23 is configured to be tiltable relative to the inner surface 26*a* of the front flange 26. The measurement recess 162 communicates with the shoe communication hole 77*b* via the first pressure measurement passage 161. Further, the measurement recess 162 largely opens, for example, in a rectangular shape toward the inner surface 26*a* of the front flange 26.

The second pressure measurement passage 163 is formed in the front flange 26. One end of the second pressure measurement passage 163 communicates (opens) with the opening of the measurement recess 162. The opening of the measurement recess 162 largely opens along the curved surface 23*b*. Thus, one end of the second pressure measurement passage 163 is maintained in a position where it is communicatively connected to the opening of the measurement recess 162 within a range in which the swash plate 23 is tilted relative to the inner surface 26*a* of the front flange 26. The other end of the second pressure measurement passage 163 is connected to the single pressure gauge 11.

That is, the pressure gauge 11 is coupled to the recess 73 in the piston 71 via the second pressure measurement passage 163, the measurement recess 162, the first pressure measurement passage 161, the shoe communication hole 77*b*, and the convex portion communication hole 72*a*. Therefore the pressure gauge 11 is able to measure the discharge pressure P1 of the first hydraulic oil and the discharge pressure P2 of the second hydraulic oil in the recess 73 alternately (separately) and regularly.

As described above, according to the hydraulic drive device 160 of the fourth embodiment, the discharge pressure P1 of the first hydraulic oil and the discharge pressure P2 of the second hydraulic oil that have been divided by the valve plate 43 can be measured with the single pressure gauge 11. Therefore, similarly to the hydraulic drive device 110 of the first embodiment, the control unit 12 calculates the average pressure based on the measured discharge pressures P1 and P2 of the first hydraulic oil and the second hydraulic oil, and further calculates the pump absorption torque from the average pressure. In this way, the control unit 12 can determine the maximum pump absorption horsepower (that is, the swash plate angle of the swash plate 23) based on the calculated pump absorption torque, for example, from the external environment or the revolution speed of the engine 1.

Based on the pump maximum absorption horsepower determined by the control unit 12, for example, the swash plate control actuator 14 is operated using the proportional solenoid valve 13 to control the swash plate 23 such that it moves at the swash plate angle determined by the control unit 12 to control the discharge flow rate. In this way, since the proportional solenoid valve 13 is provided in the torque control unit 6, the swash plate angle of the swash plate 23 can be electronically controlled and the pump absorption horsepower of the split flow main pump 15 can be accurately controlled.

The discharge pressures P1 and P2 of the first hydraulic oil and the second hydraulic oil that have been divided by the valve plate 43 can be measured by the single pressure gauge 11. Thus, similar to the hydraulic drive device 110 of the first embodiment, it is not necessary to provide two or more pressure gauges and increase of the cost of the hydraulic drive device 160 is prevented.

Further, the first pressure measurement passage 161, the measurement recess 162, and the second pressure measurement passage 163 are formed in the main pump 15. Therefore, the configuration of the hydraulic drive device 160 can be simplified as compared to the hydraulic drive device 110 of the first embodiment and the size of the hydraulic drive device 160 can be reduced.

The embodiments described herein are not intended to necessarily limit the present invention to any specific embodiments. Various modifications can be made to these embodiments without departing from the true scope and spirit of the present invention. For example, in the above-described embodiment, the construction machine 100 was a hydraulic excavator. However, the invention is not limited to this, and the above-described hydraulic drive devices 110, 140, 150, 160 can be applied for various construction machines.

Further, the hydraulic drive devices 110, 140, 150, 160 have been exemplified as the fluid pressure drive device in the above-described embodiments, but the invention is not limited to these examples. The above configurations can be applied for various fluid pressure drive devices that are driven by utilizing fluid pressure. Further, the proportional solenoid valve 13 is exemplified as the solenoid valve in the above-described embodiment, however the solenoid valve is not limited to the proportional solenoid valve. Various solenoid valves may be adopted.

Further, in the above-described embodiment, the maximum absorption horsepower of the pump (that is, the swash plate angle of the swash plate 23) is determined based on the pressure value measured by the pressure gauge 11, and the swash plate 23 of the swash plate 23 is controlled by the proportional solenoid valve 13. However the invention is not limited to this. As another example, the engine may be controlled by, for example, the proportional solenoid valve 13. In addition, the control cylinder is exemplified as the swash plate control actuator 14 in the above-described embodiment, but the invention is not limited to this. Any actuator may be used as long as it is an actuator that controls the swash plate angle of the swash plate 23 based on an electric signal from the control unit 12.

According to the fluid pressure drive device described above, it is possible to accurately control, for example, the pump absorption horsepower of a split flow pump and reduce costs.

What is claimed is:

1. A fluid pressure drive device, comprising:

a fluid pressure pump controlling discharge flow rates of discharged fluid being discharged into two or more discharge flow passages with a single swash plate;

a measurement communication passage configured to connect each of the two or more discharge flow passages and having a merging point at which the discharged fluid is discharged into each of the two or more discharge flow passages;

a single pressure detection unit detecting an intermediate pressure value of the discharged fluid merged at the merging point through a pressure measuring passage connected to the measurement communication passage; and a control unit controlling the discharge flow rates based on the intermediate pressure value detected by the pressure detection unit.

2. The fluid pressure drive device of claim 1, wherein the fluid pressure pump includes:

a cylinder which the fluid is suctioned to and discharged from; and a valve plate dividing the discharged fluid and guiding the discharged fluid discharged from the cylinder to the two or more discharge flow passages.

3. The fluid pressure drive device of claim 2, wherein the valve plate has two or more outlet ports communicated with the two or more discharge flow passages respectively, and wherein the intermediate pressure value is picked up from a passage that communicates with the two or more outlet ports.

4. The fluid pressure drive device of claim 3, wherein the fluid pressure pump has a casing that houses the cylinder and the valve plate, and wherein the intermediate pressure value is picked up from a passage that communicates with each outlet passage of the casing.

5. The fluid pressure drive device of claim 1, wherein the control unit determines a maximum absorption horsepower of the pump based on the intermediate pressure value detected by the pressure detection unit, and wherein the fluid pressure drive device further comprises a solenoid valve controlled based on the maximum absorption horsepower of the pump.

6. The fluid pressure drive device of claim 5, wherein the control unit determines a swash plate angle of the swash plate based on the maximum absorption horsepower of the pump, and wherein the solenoid valve controls the swash plate based on the swash plate angle of the swash plate.

7. The fluid pressure drive device of claim 1, wherein the single pressure detection unit detecting the intermediate pressure value is a pressure gauge that measures the intermediate pressure value.

8. The fluid pressure drive device of claim 1, wherein the control unit receives an electronic signal indicating the detected intermediate pressure value from the single pressure detection unit.

9. A fluid pressure drive device, comprising:

a fluid pressure pump controlling discharge flow rates of discharged fluid being discharged into two or more discharge flow passages with a single swash plate;

a single pressure detection unit alternately detecting a pressure value of each of the discharged fluid being discharged into the two or more discharge flow passages; and a control unit controlling the discharge flow rates based on the pressure value detected by the single pressure detection unit, wherein the fluid pressure pump includes:

a cylinder having a cylinder chamber in which the fluid is suctioned to and discharged from; and a valve plate dividing the discharged fluid discharged from the cylinder chamber and guiding the discharged fluid to the two or more discharge flow passages, wherein the cylinder includes an outer peripheral communication hole and an inner peripheral communication hole through which the discharged fluid passes, wherein the single swash plate includes:

an outer peripheral outlet port configured to discharge the discharged fluid passed through the outer peripheral communication hole, an inner peripheral outlet port configured to discharge the discharged fluid passed through the inner peripheral communication hole, a valve plate communication hole through which the discharge fluid passed through the outer peripheral communication hole and the discharge fluid passed through the inner peripheral communication hole are alternately supplied, wherein the single pressure detection unit alternately detects the pressure value of each of the discharged fluid through a pressure measuring passage connected to the valve plate communication hole.

10. The fluid pressure drive device of claim 9, wherein the control unit controls the swash plate based on an average pressure value obtained from the pressure values alternately detected by the pressure detection unit.

11. A fluid pressure drive device, comprising:

a fluid pressure pump controlling discharge flow rates of discharged fluid discharged into two or more discharge flow passages with a single swash plate;

a single pressure detection unit alternately detecting a pressure value of each of the discharged fluid being discharged into the two or more discharge flow passages; and a control unit controlling the discharge flow rates based on the pressure value detected by the pressure detection unit, wherein the fluid pressure pump includes:

a cylinder having a cylinder chamber in which the fluid is suctioned to and discharged from; and a piston movable in the cylinder chamber, the piston suctioning fluid into the cylinder chamber and discharging fluid from the cylinder chamber, wherein a recess is formed in the piston to store the fluid in the cylinder chamber, wherein the single swash plate includes:

a first pressure measurement passage configured to connect to the recess; and a measurement recess configured to connect to the first pressure measurement passage, wherein the single pressure detection unit alternately detecting the pressure value of each of the discharged fluid through a second pressure measurement passage connected to the measurement recess.

* * * * *